US012642316B2

(12) United States Patent
Palomo et al.

(10) Patent No.: US 12,642,316 B2
(45) Date of Patent: Jun. 2, 2026

(54) GOWN

(71) Applicant: Allegiance Corporation, Waukegan, IL (US)

(72) Inventors: Joseph Angelo Palomo, Fox Lake, IL (US); Eric Dale Euteneuer, Nevis, MN (US); Lianhong Wang, Singapore (SG); Kyle Alexander Cushman, Powell, OH (US); Rogelio Reyes, El Paso, TX (US); Armando Quinonez, El Paso, TX (US); Stephen James Cox, Gurnee, IL (US)

(73) Assignee: ALLEGIANCE CORPORATION, Waukegan, IL (US)

( * ) Notice: Subject to any disclaimer, the term of this patent is extended or adjusted under 35 U.S.C. 154(b) by 0 days.

(21) Appl. No.: 18/104,644

(22) Filed: Feb. 1, 2023

(65) Prior Publication Data

US 2023/0172293 A1 Jun. 8, 2023

Related U.S. Application Data

(62) Division of application No. 16/411,975, filed on May 14, 2019, now Pat. No. 11,602,181.
(Continued)

(51) Int. Cl.
*A41D 13/12* (2006.01)
*A41D 27/00* (2006.01)

(52) U.S. Cl.
CPC ..... *A41D 13/1209* (2013.01); *A41D 13/1245* (2013.01); *A41D 13/129* (2013.01);
(Continued)

(58) Field of Classification Search
CPC ..... A41D 13/1209; A41D 13/1245; A41D 13/129; A41D 13/12; A41D 13/1236;
(Continued)

(56) References Cited

U.S. PATENT DOCUMENTS 3,129,432 A 4/1964 Belkin
3,230,546 A * 1/1966 Sabee ..... A41D 13/1209 2/114
(Continued)

FOREIGN PATENT DOCUMENTS

CA 129367 S 8/2009
CA 135042 S 11/2010
(Continued)

OTHER PUBLICATIONS

CDC Webpage on AAMI dated Nov. 15, 2020, retrieved at https://wwwn.cdc.gov/PPEInfo/Standards/Info/ANSI/AAMIPB70Class3 on Oct. 24, 2020 (Year: 2020).
(Continued)

*Primary Examiner* — F Griffin Hall
(74) *Attorney, Agent, or Firm* — ArentFox Schiff LLP and Cardinal Health

(57) ABSTRACT

A garment, particularly a garment useful in a medical setting, comprising a gown that provides an acceptable barrier between a wearer and certain contaminants as well as easy doffing, the gown having a neck opening, two sleeves, a body portion including a front body portion and a back body portion, one or more panels, and/or one or more doffing features.

18 Claims, 43 Drawing Sheets

Related U.S. Application Data

(60) Provisional application No. 62/671,241, filed on May 14, 2018.

(52) U.S. Cl.
CPC ..... *A41D 27/00* (2013.01); *A41D 2400/44* (2013.01); *A41D 2500/50* (2013.01); *A41D 2600/20* (2013.01)

(58) Field of Classification Search
CPC ..... A41D 13/1254; A41D 13/1263; A41D 2400/44; A41D 2500/50; A41D 2600/20
USPC ..... 2/114, 457; D2/720
See application file for complete search history.

(56) References Cited

U.S. PATENT DOCUMENTS

| | | | | |
|---|---|---|---|---|
| 3,720,957 | A | 3/1973 | Patience | |
| D236,293 | S | 8/1975 | Banks | |
| 3,911,499 | A | 10/1975 | Benevento et al. | |
| 4,718,124 | A | 1/1988 | Sawicki et al. | |
| D305,575 | S | 1/1990 | Gordon et al. | |
| 5,088,117 | A | 2/1992 | Fulmer | |
| 5,271,100 | A | 12/1993 | Holt | |
| D351,712 | S | 10/1994 | Frank | |
| D356,204 | S | 3/1995 | Derrickson | |
| 5,545,464 | A | 8/1996 | Stokes | |
| D374,113 | S | 10/1996 | Console | |
| 6,460,187 | B1 | 10/2002 | Siegel | |
| D495,468 | S | 9/2004 | Wheeler-Dickson et al. | |
| 6,792,622 | B2 * | 9/2004 | Graves | A41D 13/1254 2/912 |
| D533,982 | S | 12/2006 | Graneto et al. | |
| D564,730 | S | 3/2008 | Farrell | |
| D565,279 | S | 4/2008 | Farrell | |
| D598,638 | S | 8/2009 | Graneto et al. | |
| D613,035 | S | 4/2010 | Lunt et al. | |
| D618,884 | S | 7/2010 | Zhu | |
| D622,934 | S | 9/2010 | Graneto, III | |
| D624,280 | S | 9/2010 | Halseth | |
| 7,802,313 | B2 * | 9/2010 | Czajka | A41D 13/1209 2/457 |
| 7,971,274 | B2 * | 7/2011 | Graneto, III | A41D 13/1209 2/114 |
| D646,463 | S | 10/2011 | Petrovskis et al. | |
| D647,688 | S | 11/2011 | Hilgart | |
| D653,019 | S | 1/2012 | Bond | |
| D657,939 | S | 4/2012 | Mathews | |
| D687,209 | S | 8/2013 | Levine | |
| D690,078 | S | 9/2013 | Anderson | |
| D721,870 | S | 2/2015 | Levine | |
| D736,493 | S | 8/2015 | Pasko | |
| D741,044 | S | 10/2015 | Pasko | |
| D749,819 | S | 2/2016 | Czajka et al. | |
| D764,748 | S | 8/2016 | Czajka et al. | |
| D774,729 | S | 12/2016 | Pasko | |
| 9,521,871 | B2 * | 12/2016 | Bolla | A41D 13/1245 |
| D779,155 | S | 2/2017 | Pasko et al. | |
| D779,156 | S | 2/2017 | Pasko | |
| D781,528 | S | 3/2017 | Kennedy | |
| D785,284 | S | 5/2017 | Pasko | |
| D787,780 | S | 5/2017 | Pasko et al. | |
| D791,434 | S | 7/2017 | Pasko | |
| D792,056 | S | 7/2017 | Reese et al. | |
| D793,031 | S | 8/2017 | Jascomb | |
| D793,651 | S | 8/2017 | Jascomb | |
| D796,781 | S | 9/2017 | Calucci | |
| D797,401 | S | 9/2017 | Jascomb | |
| D802,884 | S | 11/2017 | Bennett | |
| D805,733 | S | 12/2017 | Reese et al. | |
| D821,704 | S | 7/2018 | Pasko | |
| 10,117,470 | B2 * | 11/2018 | Reese | A41D 13/1209 |
| 2001/0034891 | A1 | 11/2001 | Matsushita | |
| 2006/0277655 | A1 | 12/2006 | Kerr | |
| 2011/0154554 | A1 | 6/2011 | Furlong | |
| 2012/0204316 | A1 * | 8/2012 | Hutton | A41D 13/1236 2/114 |
| 2013/0091615 | A1 | 4/2013 | Pasko et al. | |
| 2013/0191960 | A1 | 8/2013 | Pasko | |
| 2013/0276203 | A1 | 10/2013 | Pasko et al. | |
| 2013/0276204 | A1 | 10/2013 | Pasko et al. | |
| 2013/0283496 | A1 | 10/2013 | Pasko et al. | |
| 2013/0318682 | A1 | 12/2013 | Graneto, III | |
| 2014/0007316 | A1 | 1/2014 | Tommarello et al. | |
| 2015/0135398 | A1 | 5/2015 | Czajka et al. | |
| 2015/0150318 | A1 | 6/2015 | Terrell | |
| 2015/0208741 | A1 | 7/2015 | Pasko | |
| 2016/0066631 | A1 | 3/2016 | Pasko | |
| 2016/0220852 | A1 * | 8/2016 | Samaniego | A41D 27/00 |
| 2019/0053551 | A1 * | 2/2019 | Jascomb | A41D 13/1227 |

FOREIGN PATENT DOCUMENTS

| | | | | |
|---|---|---|---|---|
| CA | 144543 | S | 6/2013 | |
| CA | 156205 | S | 1/2015 | |
| CA | 155647 | S | 10/2015 | |
| CA | 158339 | S | 4/2016 | |
| CA | 158380 | S | 4/2016 | |
| CA | 171333 | S | 7/2017 | |
| CN | 305191265 | S | 6/2019 | |
| DE | 7304791 | U | 11/1973 | |
| DE | 102011016497 | A1 | 10/2012 | |
| DE | 202014103297 | U1 * | 9/2014 | A41D 13/1209 |

OTHER PUBLICATIONS

Aug. 5, 2019 International Search Report and Written Opinion issued in International Patent Application No. PCT/US19/32219.

* cited by examiner

GOWN

CROSS-REFERENCE TO RELATED APPLICATION

This application is a Divisional of U.S. application Ser. No. 16/411,975, filed May 14, 2019, which claims priority to U.S. Provisional Application No. 62/671,241, filed May 14, 2018, the disclosures of which is expressly incorporated herein by reference.

TECHNICAL FIELD

The present disclosure is directed to garments useful in a medical setting.

BACKGROUND OF THE DISCLOSURE

Gowns are of particular importance in many medical settings, as they protect wearers from potentially harmful environmental contaminants. One important feature of such gowns is their barrier function, or their ability to provide a barrier between a wearer and environmental contaminants. Another important feature is the ability to efficiently apply or remove the gown from the wearer when desired, that is, easy donning and/or doffing of the gown. Some of the gowns presently known in the art are provided with features that facilitate easy donning and/or doffing thereof. However, these features often compromise the barrier function of the gowns, for example, by allowing unacceptable penetration of environmental contaminants. There is thus a need in the art for garments useful in medical settings that provide both an acceptable barrier function as well as easy donning and/or doffing when desired.

BRIEF DESCRIPTION OF THE DISCLOSURE

The present disclosure is directed to a garment, particularly a garment useful in a medical setting, such as in a hospital, doctor's office, health care facility, or a similar environment. According to some aspects, the garment comprises a gown, particularly a gown that provides an acceptable barrier between a wearer and certain contaminants. According to some aspects, the garment may be configured to provide easy donning and/or doffing while still providing acceptable barrier function. The present disclosure is also directed to methods of making and using the garments as described herein.

DETAILED DESCRIPTION OF THE DISCLOSURE

The present disclosure is directed to a garment, particularly a garment useful in a medical setting, such as in a hospital, doctor's office, health care facility, or a similar environment. According to some aspects, the garment comprises a gown, particularly a gown (e.g., an isolation gown or a surgical gown) that provides an acceptable barrier between a wearer and certain contaminants. According to some aspects, the garment may be configured to provide easy donning and/or doffing while still providing acceptable barrier function. The present disclosure is also directed to methods of making and using the garments as described herein.

According to some aspects, the garment comprises a gown. As used herein, the term "gown" refers to an article of apparel comprising a neck opening, two sleeves, and a body portion, including a front body portion and a back body portion. According to some aspects, the two sleeves and at least a portion of the body portion may be formed from a single component, such as a single piece of material that has been sealed together to form all or a portion of the gown. According to some aspects, the garment may comprise one or more additional components, such as one or more closing devices and/or one or more panels. As used herein, the term "panel" refers to a portion of the garment that is formed from a separate component than the component used to form the two sleeves and at least a portion of the body portion. It should be understood, however, that the one or more panels may be provided as part of the body portion (e.g., as part of the back body portion in the assembled garment) and/or in addition to the body portion (e.g., by overlapping at least part of the back body portion in the assembled garment).

Figure 1:
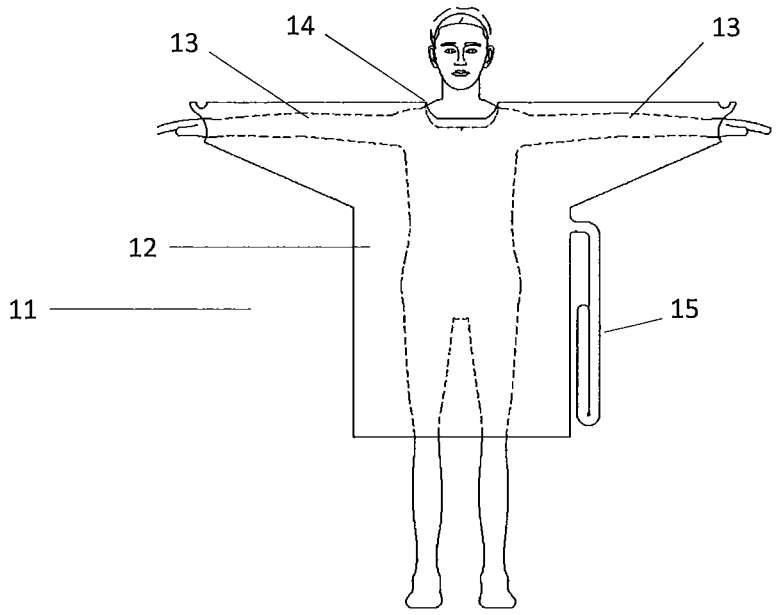
FIG. 1 shows an example front view of a garment according to aspects of the present disclosure.

FIG. 1 shows an example front view of a garment 11 which comprises a main body portion 12, two sleeves 13, and a neck opening 14. The sleeves may be configured as shown in the figures (with thumb holes) or any way known in the art. The garment 11 may further comprise a closing device 15, such as a belt. It should be understood that the closing device 15, such as a belt as shown in FIG. 1, may comprise one or more portions, or ties, which may be provided in an open and/or closed position, such that when the closing device is in the closed position, the closing device may aid in securing the garment on a wearer.

Figure 2A:
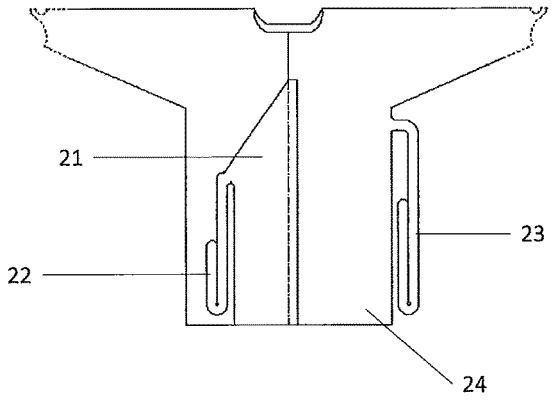
FIG. 2A shows an example back view of a garment according to aspects of the present disclosure.
Figure 2B:
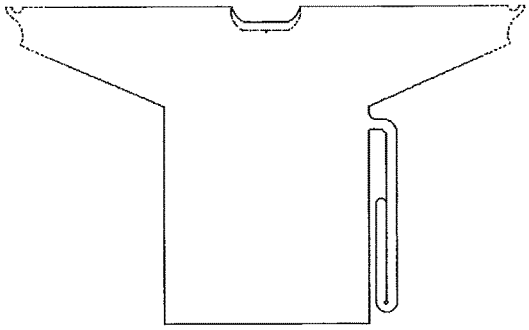
FIG. 2B shows an example front view of a garment according to aspects of the present disclosure.

As shown in FIG. 2A, the garment may further comprise one or more panels. For example, FIG. 2A and FIG. 2B show an example back view and an example front view of a garment, respectively. It should be understood that while the terms "back" and "front" are used herein, these terms are not intended to be limiting (i.e., the garment may alternatively be worn such that the "front" side of the garment is on the back of a wearer and vice versa). As can be seen in FIG. 2A, the back of the garment may comprise a panel 21. In this example, the panel 21 may be configured to include a first portion 22, or first tie, of the closing device (e.g., a belt), wherein the first portion 22 may interact with a second portion 23, or second tie, to provide the closing device in a closed position. In particular, the first portion 22 and the second portion 23 may together form a belt that, when tied, helps secure the garment to a wearer. As can be seen in FIG. 2A, the panel 21 may be provided in addition to (e.g., fixed to) the body portion of the garment (i.e., by overlapping at least part of the back body portion 24 of the assembled garment).

Figure 3A:
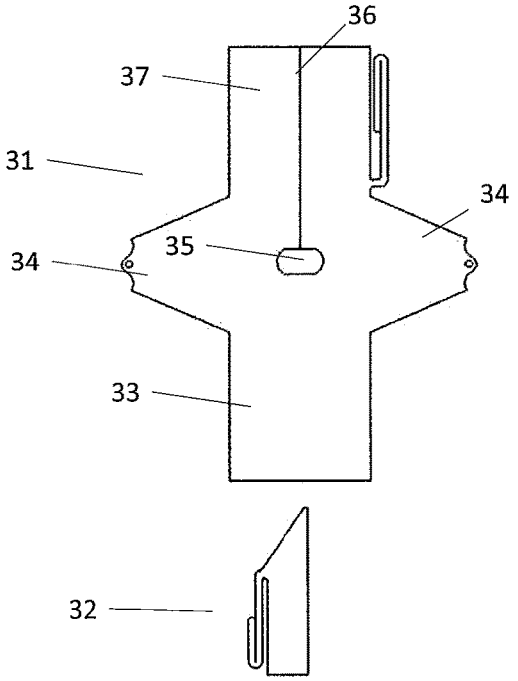
FIG. 3A shows an example schematic for assembling a garment according to aspects of the present disclosure.
Figure 3B:
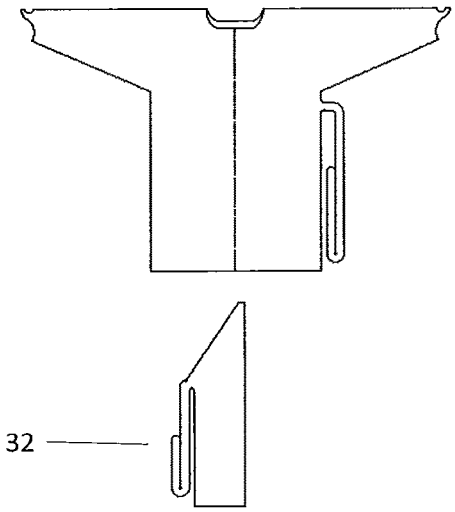
FIG. 3B shows an example schematic for assembling a garment according to aspects of the present disclosure.

FIGS. 3A and 3B show an example schematic for assembling a garment according to the present disclosure, for example, the garment shown in FIGS. 2A and 2B. As shown in FIG. 3A, assembling the garment may comprise providing a first component 31, which, when assembled, will form the main body portion, including front body portion 33 and back body portion 37 as well as the neck opening 35, and the two sleeves 34 of the garment. As shown in FIG. 3A, the first component 31 may be provided with one or more slits 36, for example, a slit extending from the neck opening 35 to a location on the first component 31 that will become the back body portion 37 of the garment when assembled. In one example, slit 36 may extend from the neck opening 35 through the opposite edge of the first component 31, as shown in FIG. 3A. In other examples, the slit may partially extend from the neck opening 35 to a predetermined point in the back body portion 37. A second component 32 may also be provided, which, when assembled, will form the panel.

Figure 4:
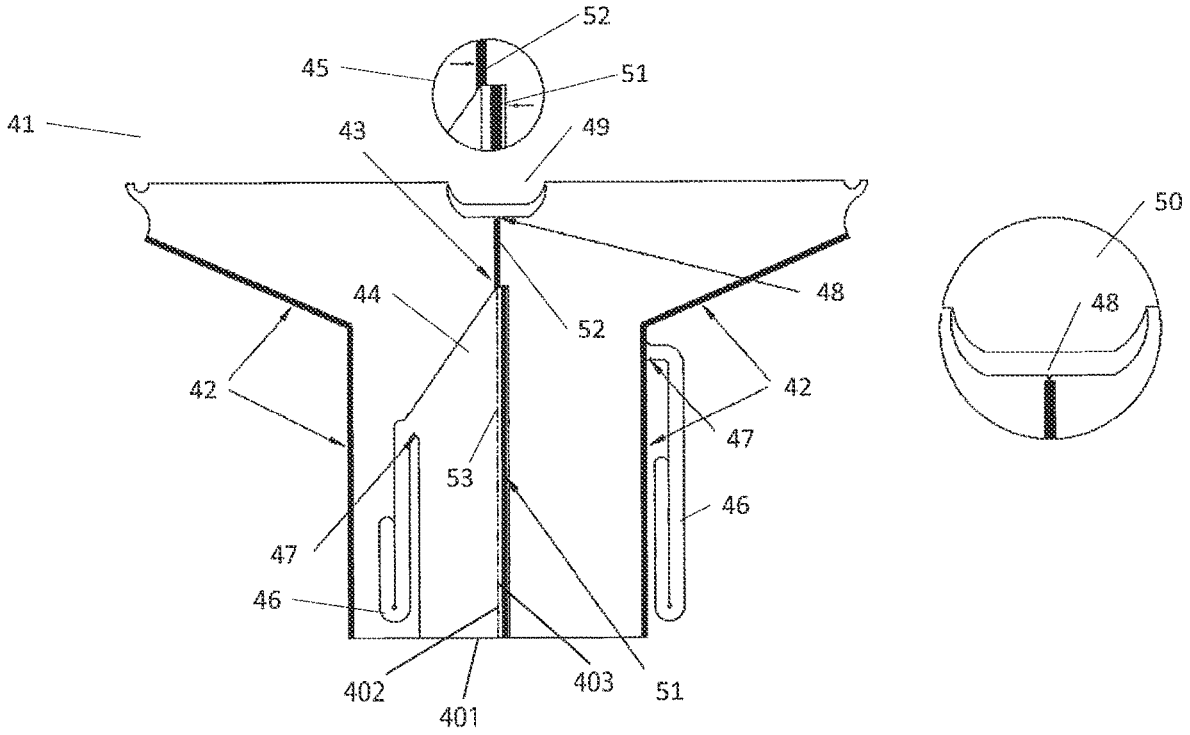
FIG. 4 shows an example back view of an assembled garment according to aspects of the present disclosure.

As can be seen in FIG. 3B, the garment may be assembled by first folding the first component 31 over along a line bisecting the neck opening 35 and sealing the edges thereof together to form the garment. For example, FIG. 4 shows an example back view of the assembled garment 41, wherein then edges 42 of the first component are sealed together to form the garment. The optional slit 43 provided in the first component may also be sealed using the same type of seal used to seal the edges 42. It should also be understood, however, that a different type of seal may alternatively be used. According to some aspects, the entire optional slit 43 may be sealed, or only a portion of the optional slit 43 may be sealed, as discussed herein. It should be understood that the sealed portion of the optional slit 43 as described herein is one example of a pre-closed configuration. As used herein, the term "pre-closed configuration" refers to a configuration that is substantially free of openings. For example, as shown in FIG. 4, the optional slit 43 is formed from a second edge 402 of the first component and a third edge 403 of the first component, and it extends from the neck opening 49 to a first edge 401 of the first component. In this example, the sealed portion 52 of the optional slit 43 may optionally be provided in a pre-closed configuration via the seal such that the sealed portion is substantially free of openings. Alternatively or additionally, all or a portion of the optional slit 43 may be provided in a pre-closed configuration via one or more fasteners. Examples of fasteners useful according to the present disclosure include, but are not limited to, a tie, snap, button, fabric hook and loop fastener, zipper, buckle, hook and eye, cord, toggle, brooch, eyelet, magnet, and/or combinations thereof. In additional embodiments, the gown may be assembled without folding the first component. For example, the gown may be assembled with two separate components and comprise additional heat seals.

As shown in FIG. 4, the second component (e.g., the second component 32 shown in FIGS. 3A and 3B) may also be attached to the first component to form the panel 44 as described herein in the assembled garment. For example, the same type of seal used to seal the edges 42 of the garment may also be used to attach the panel 44 to the body portion of the garment, for example, as shown along seal 51. It should be understood, however, that a different type of seal that the seal used to seal the edges 42 of the garment may be used to attach panel 44 so long as the panel is adequately attached. It should also be understood that the seal or fastener(s) used to provide the pre-closed portion 52 of the optional slit 43 may be aligned with the seal used to attach panel 44 to the body portion of the garment (i.e., along seal 51), or, as can be seen in the enlarged section 45 of FIG. 4, they may be offset (for example, by between 0.1 and 4 cm) and preferably generally parallel to each other. In this way, when the garment is worn by a wearer, the panel 44 may be wrapped over (i.e., overlay) the unsealed or open portion 53 of the optional slit 43 formed from the second edge 402 of the first component and the third edge 403 of the first component, and optionally secured by the closing device 46, to provide acceptable barrier function. The panel may be attached over the pre-closed portion 52 so that it overlaps the pre-closed portion 52. Alternatively, the panel may not overlap the pre-closed portion 52.

As shown in FIG. 4, the assembled garment 41 may further comprise one or more slits. For example, the closing device 46 may comprise one or more slits 47 configured to provide easy doffing of the garment, that is, easy removal of the garment from a wearer (for example, by providing a point of the garment that is more easily torn than other portions of the garment, when desired). Alternatively or additionally, the garment may comprise at least one notch 48 extending from the neck opening 49 to a point on the front body portion and/or the back body portion, preferably the back body portion. For example, as shown in enlarged section 50 of FIG. 4, the notch 48 may be provided by leaving a section of slit 43 unsealed and/or open during assembly of the garment, that is, without sealing and/or pre-closing slit 43 all the way to the neck opening 49. In this way, the neck opening 49 may comprise a notch 48 that is configured to provide easy doffing of the garment. It should be understood, however, that none of the slits or notches comprised by the assembled garment (e.g., slits 47 or notch 48) will interfere with the barrier function of the garment, as will be discussed in detail herein. In additional embodiments, the notch 48 may also be a slit or any other known tear initiating features in the art.

Figure 10:
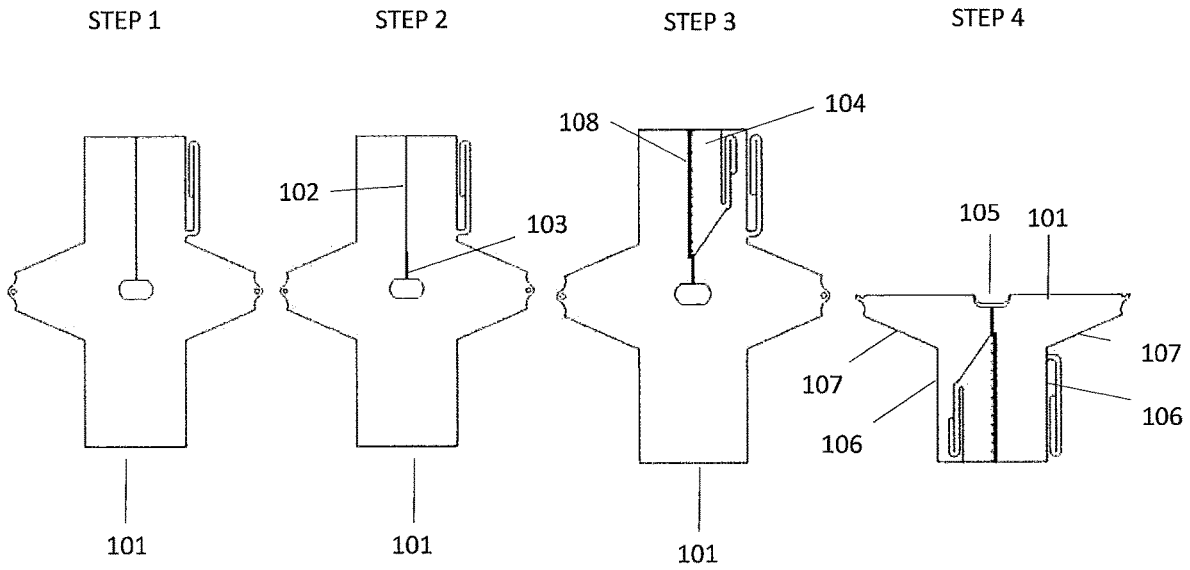
FIG. 10 shows an example schematic for assembling a garment according to aspects of the present disclosure.

FIG. 10 shows a second example schematic for assembling a garment according to the present disclosure, for example, the garment shown in FIGS. 2A and 2B. As can be seen in FIG. 10, assembling the garment may comprise providing a first component 101 in Step 1. In Step 2, a portion of the slit 102 may be sealed and/or pre-closed at pre-closed portion 103, as described herein (for example, with reference to FIG. 4). In Step 3, a second component 104 may be attached to the first component 101 along seal 108, as described herein (for example, with reference to FIG. 4). In Step 4, the garment may be assembled by folding the first component 101 over along a line bisecting the neck opening 105, and may be sealed along the sides 106 and/or sleeves 107, as described herein (for example, with reference to FIG. 4).

Figure 5:
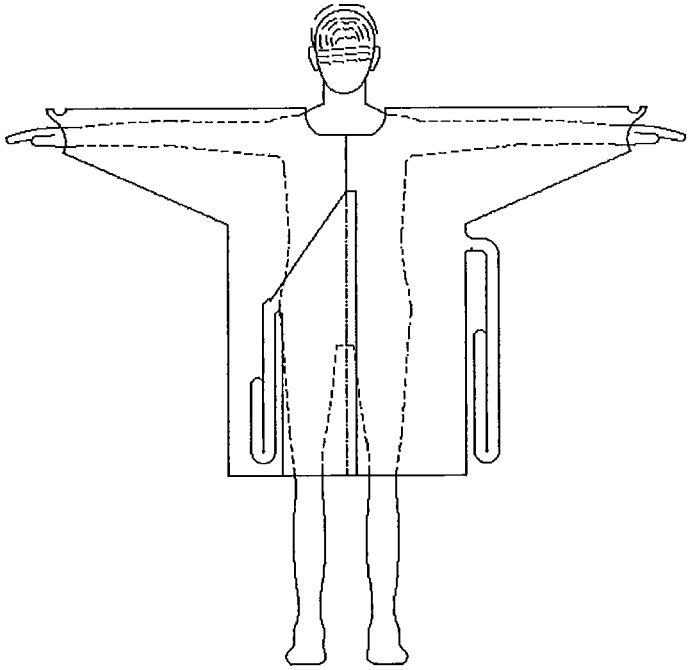
FIG. 5 shows an example back view of the garment shown in FIG. 4 when worn by a wearer according to aspects of the present disclosure.

FIG. 5 shows an example back view of the garment shown in FIG. 4 and/or FIG. 10 when worn by a wearer.

Figure 6A:
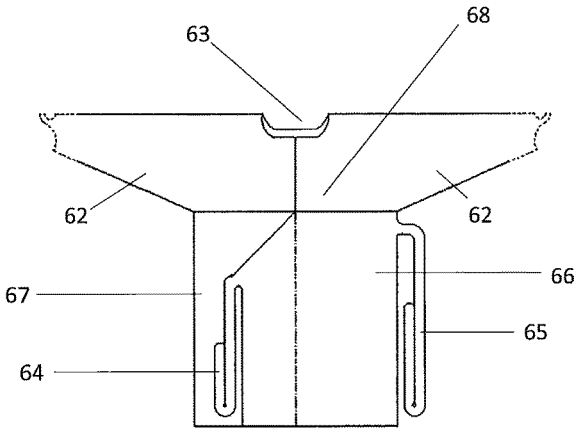
FIG. 6A shows an example back view of a garment according to aspects of the present disclosure.
Figure 6B:
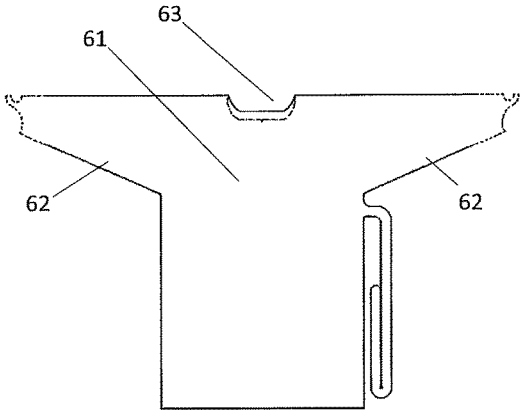
FIG. 6B shows an example front view of a garment according to aspects of the present disclosure.

FIGS. 6A and 6B show another example back view and example front view of a garment, respectively. Similar to the garment shown in FIGS. 2A and 2B, the garment in FIGS. 6A and 6B may comprise a front body portion 61, a back body portion 68, two sleeves 62, and a neck opening 63. The garment may further comprise a closing device (e.g., a belt or ties), wherein a first portion 64 thereof may interact with a second portion 65 thereof to provide the closing device in a closed position. The garment may further comprise a first panel 67 and a second panel 66. The first panel 67 and the second panel 66 may together form a portion of the main body portion of the assembled garment, i.e., a portion of back body portion 68.

Figure 7A:
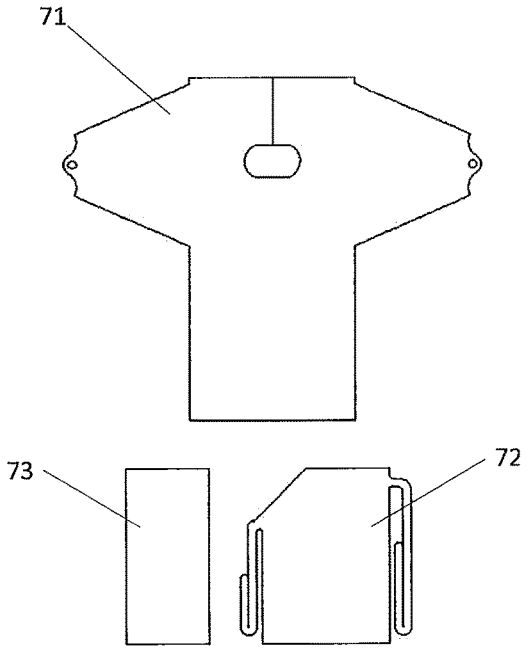
FIG. 7A shows an example schematic for assembling a garment according to aspects of the present disclosure.
Figure 7B:
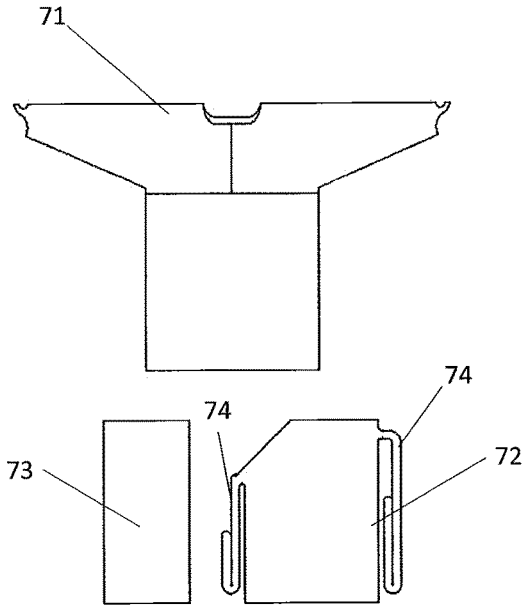
FIG. 7B shows an example schematic for assembling a garment according to aspects of the present disclosure.
Figure 12A:
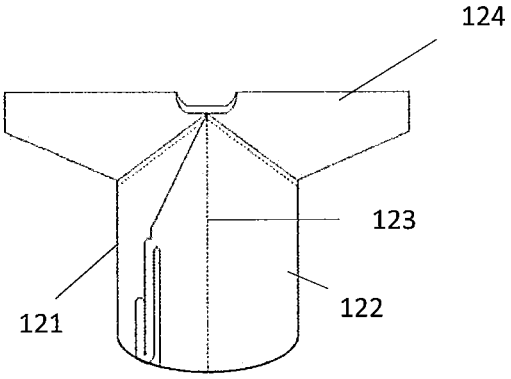
FIG. 12A shows an example schematic for assembling a garment according to aspects of the present disclosure.
Figure 12B:
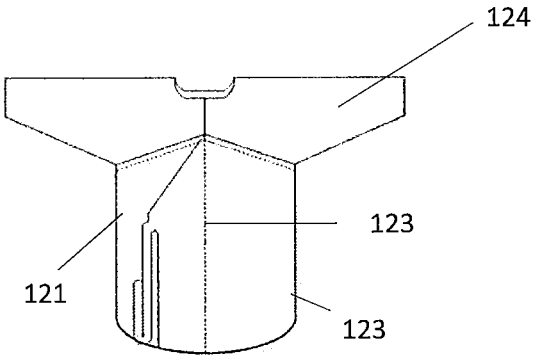
FIG. 12B shows an example schematic for assembling a garment according to aspects of the present disclosure.
Figure 13:
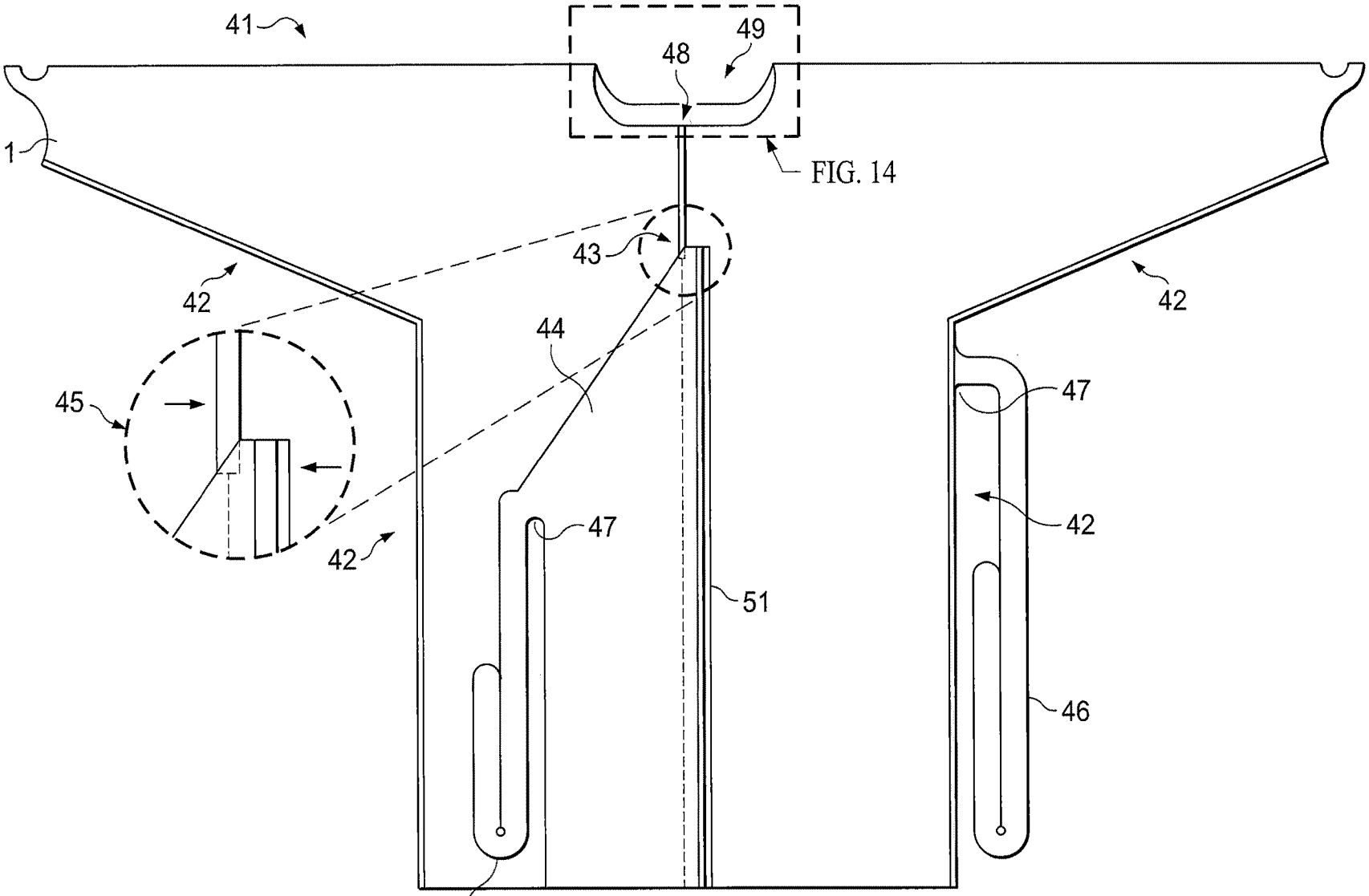
FIGS. 13-56 show additional views and features of a garment according to aspects of the present disclosure.
Figure 14:
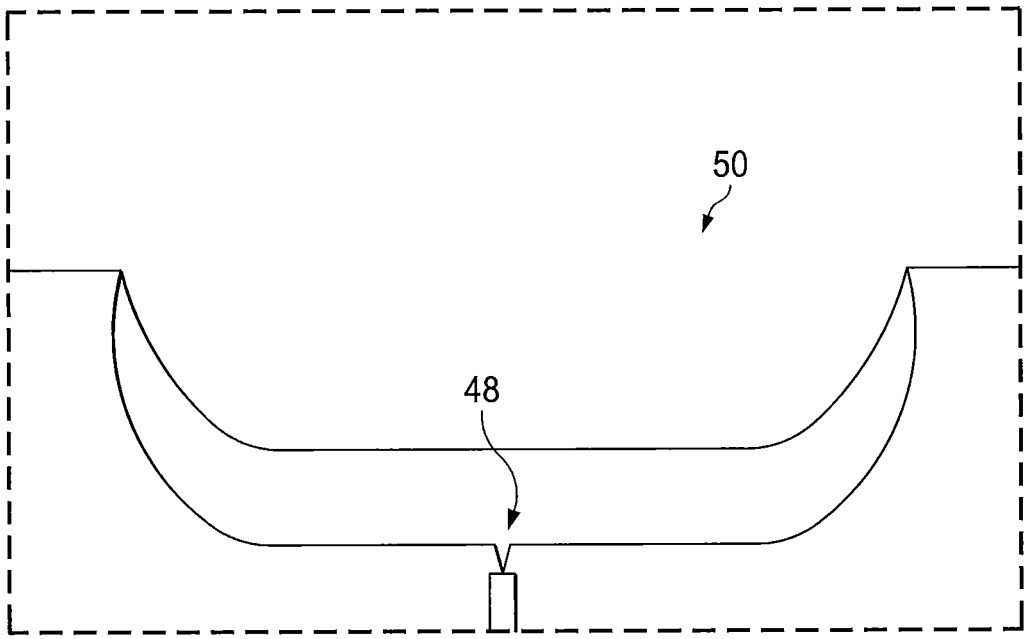
Figure 15:
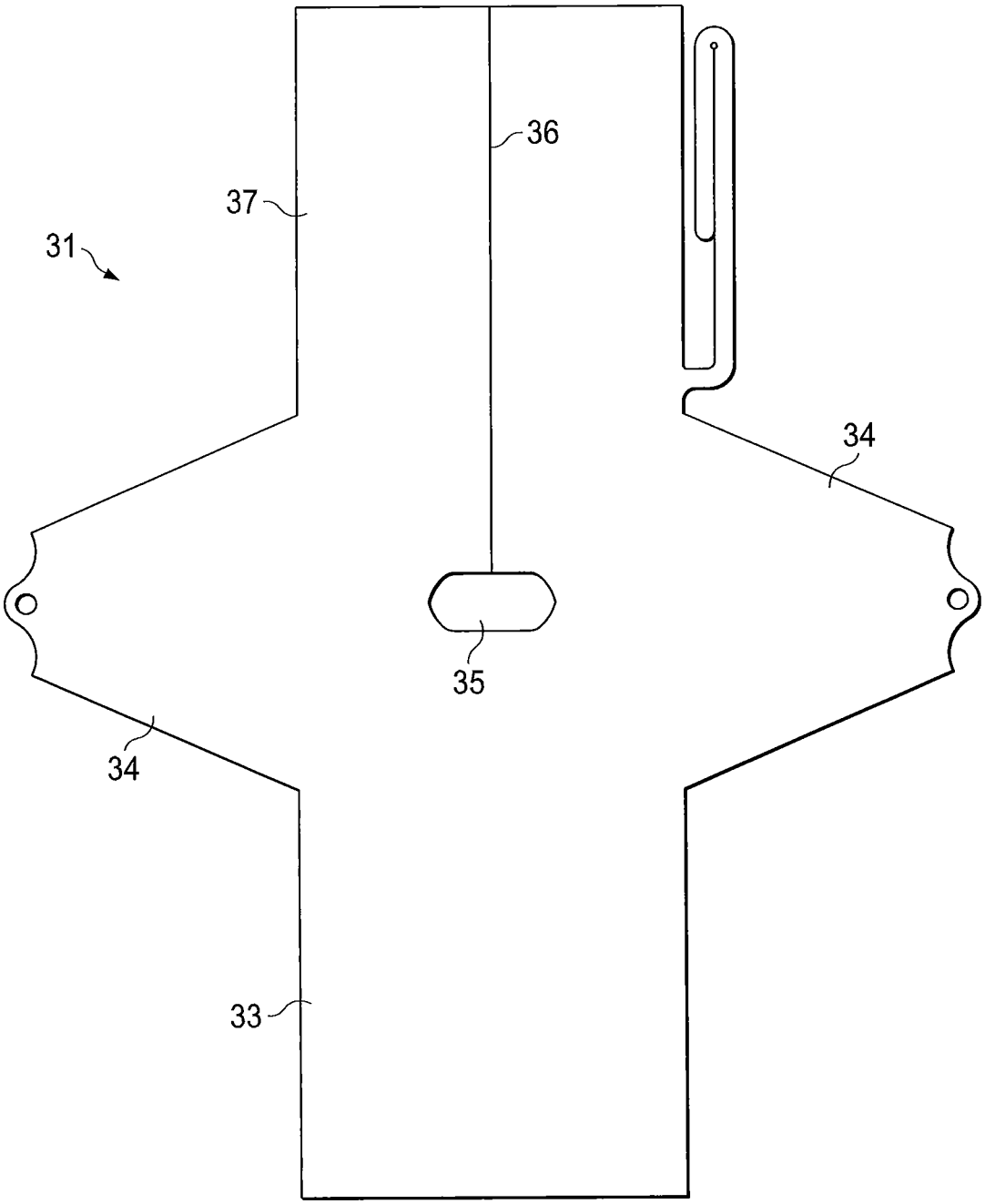
Figure 16:
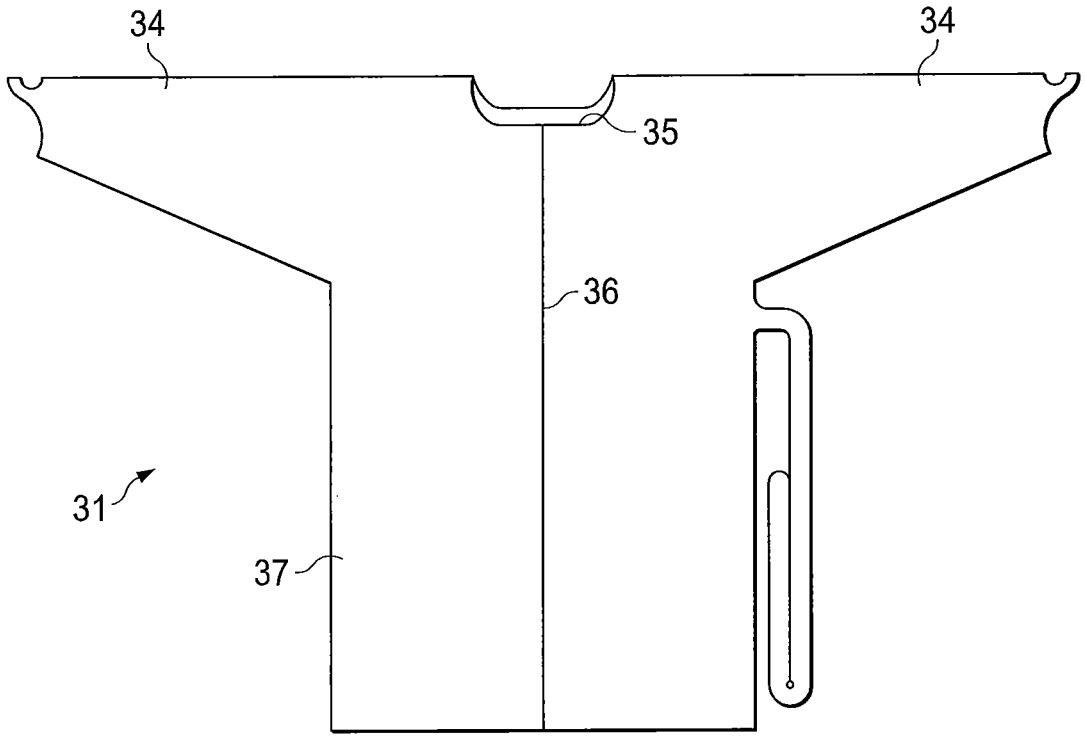
Figure 17:
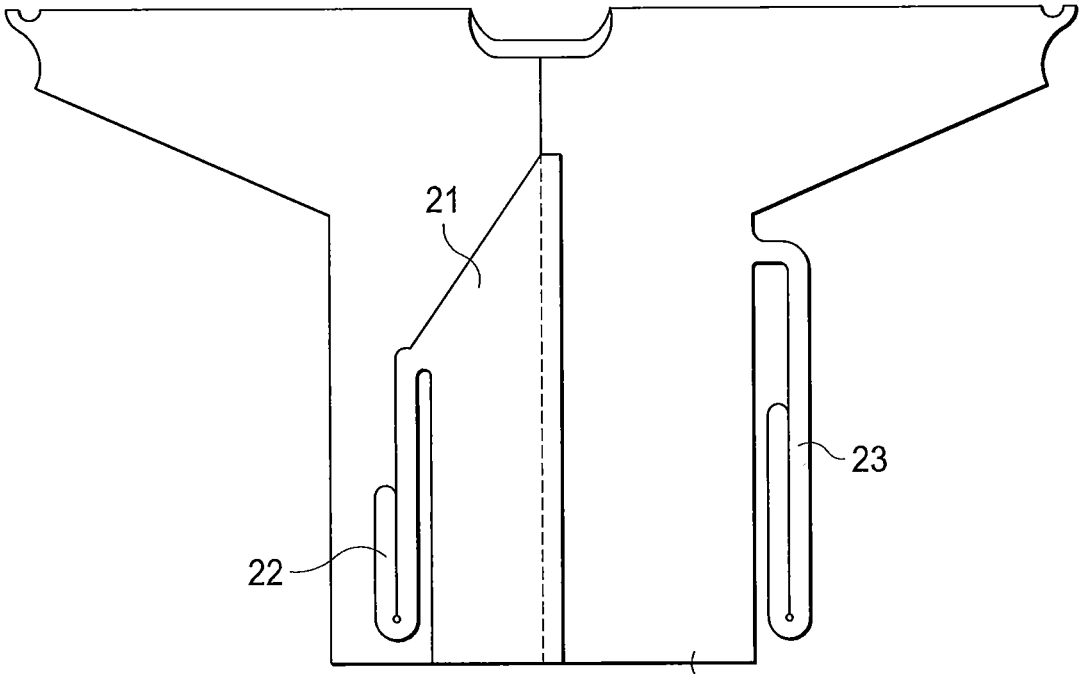
Figure 18:
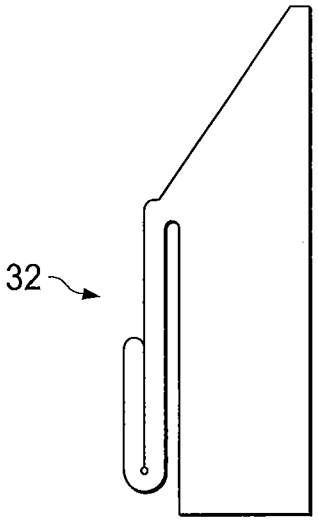
Figure 20:
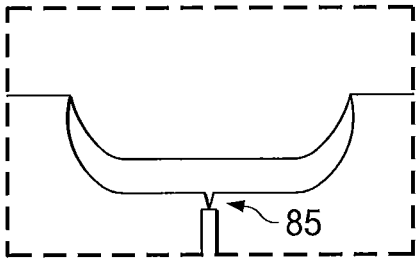
Figure 19:
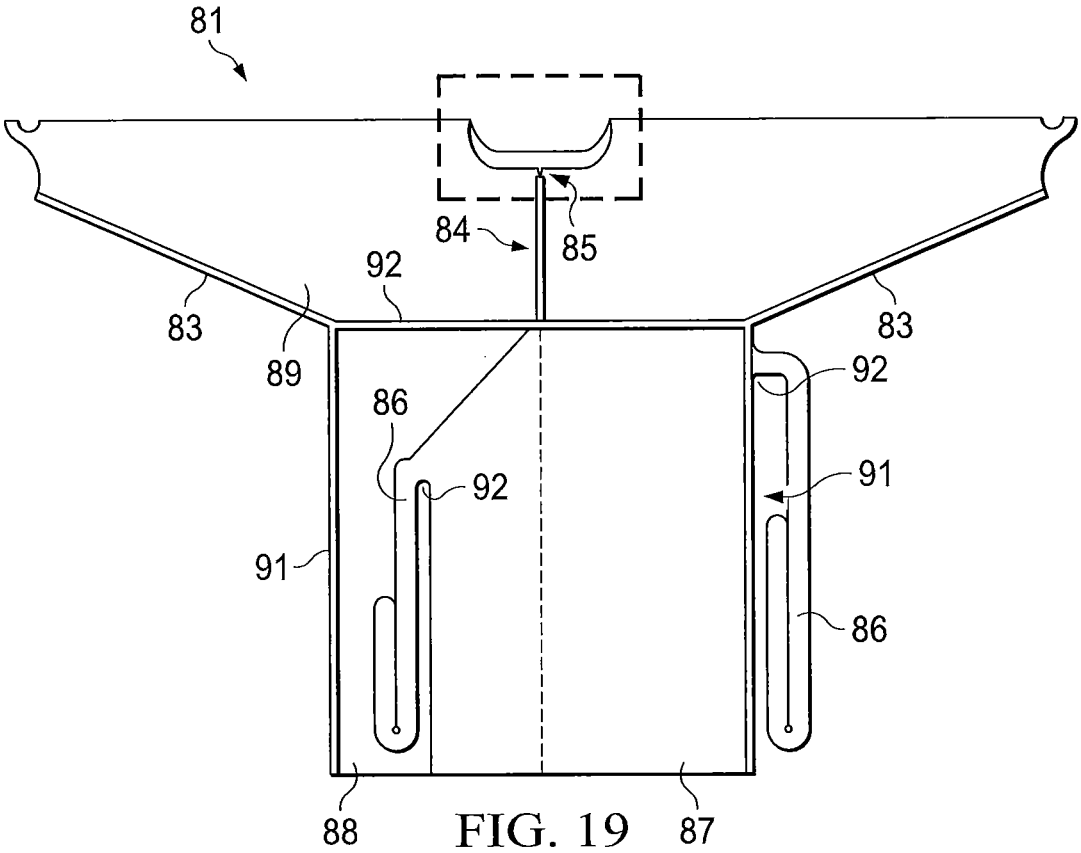
Figure 21:
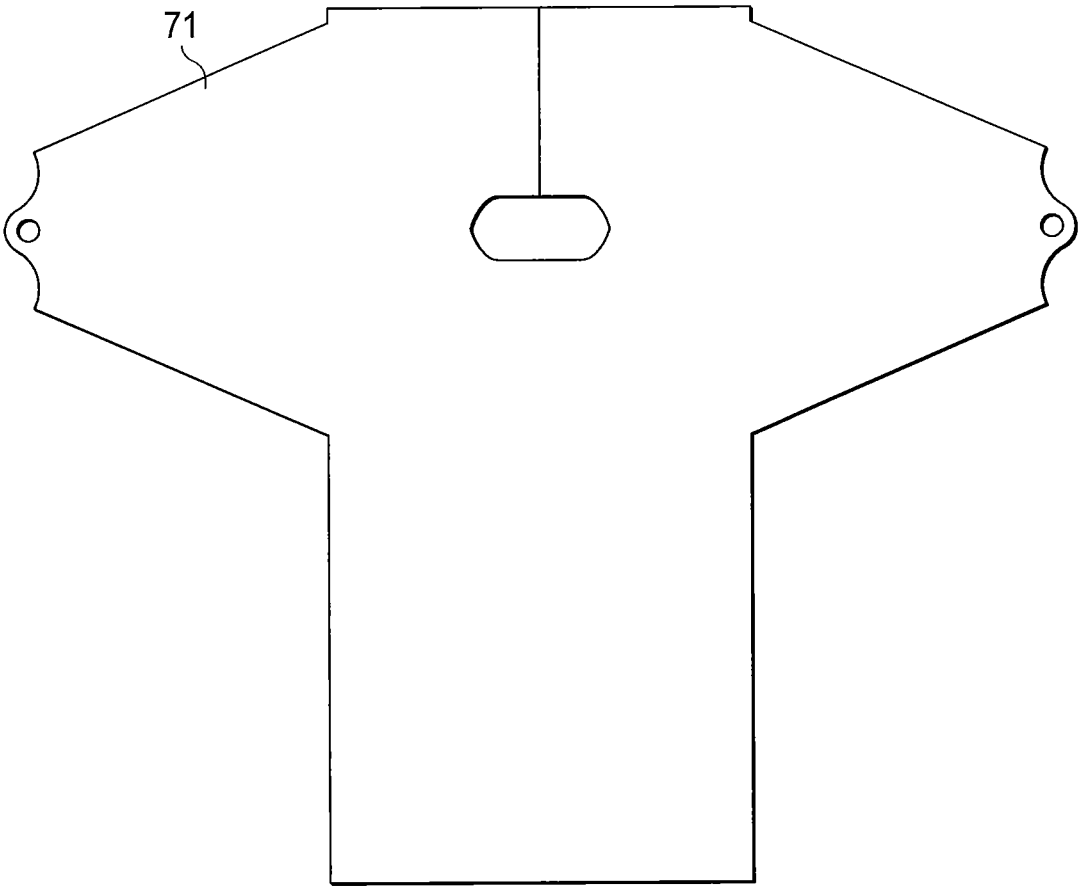
Figure 24:
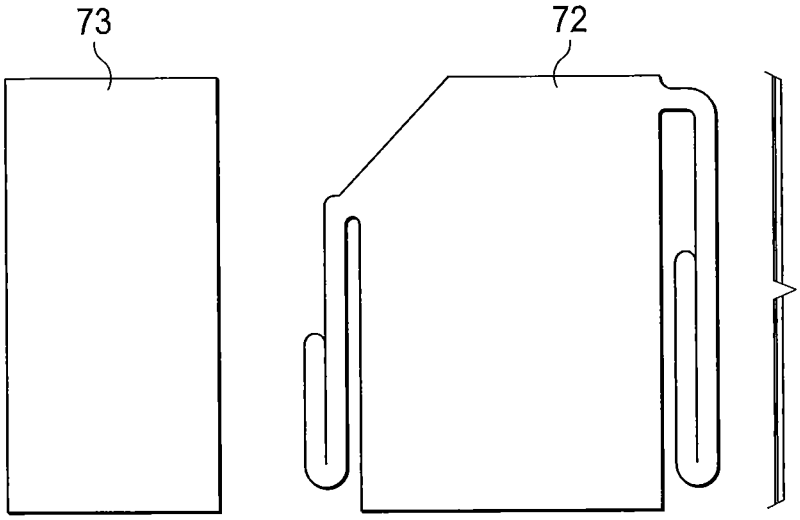
Figure 22:
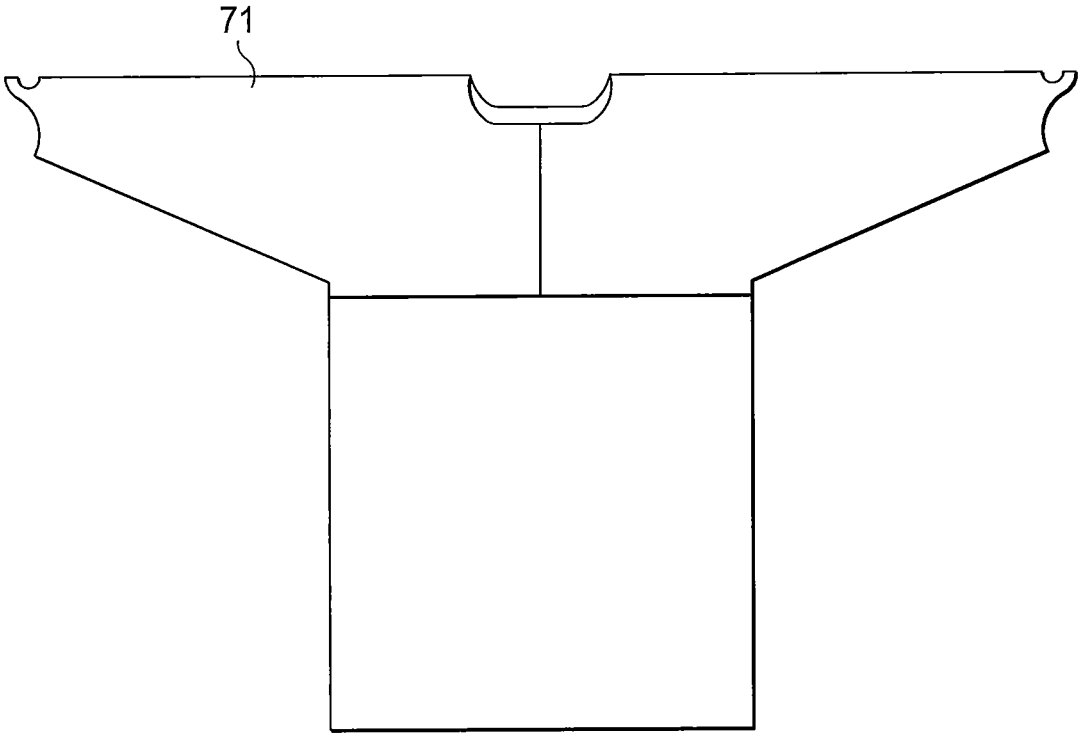
Figure 23:
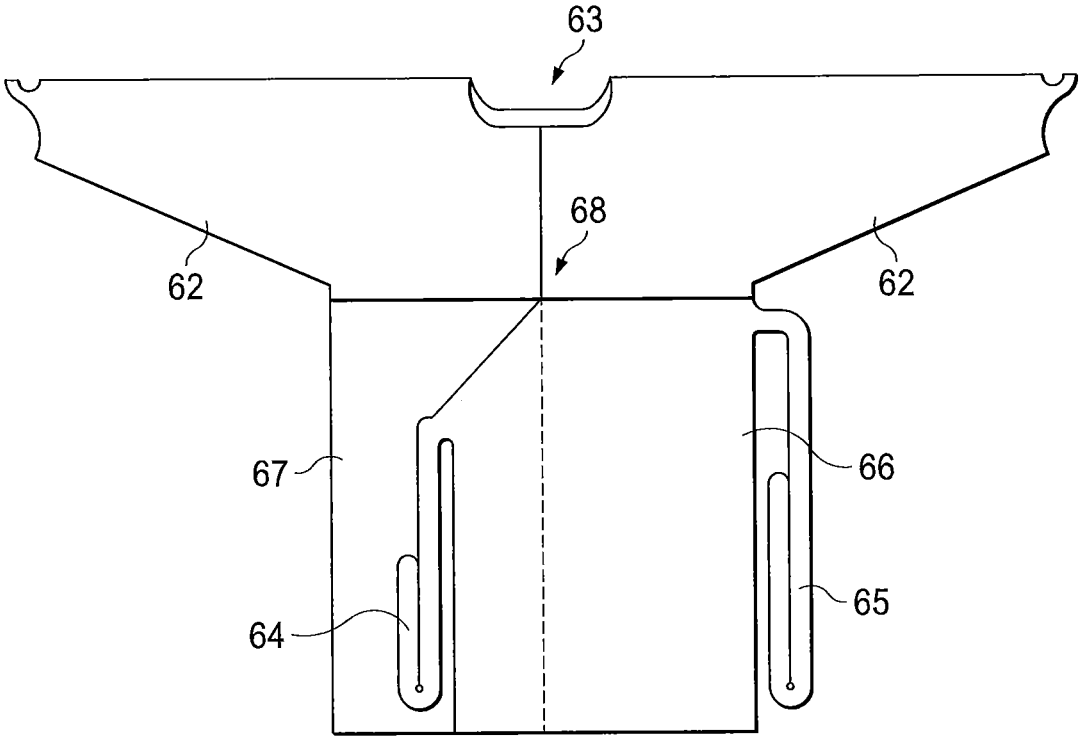
Figure 25:
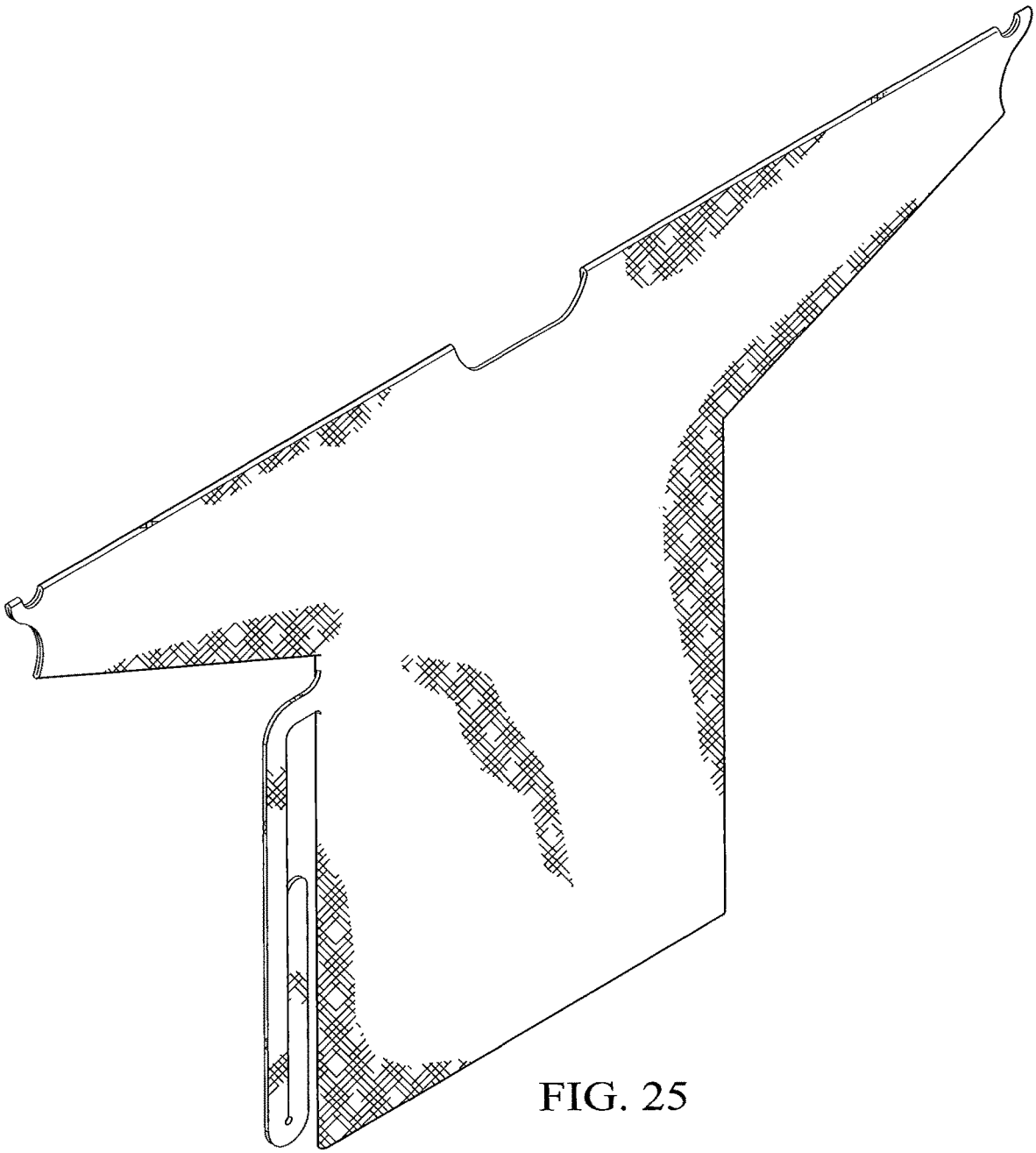
Figure 26:
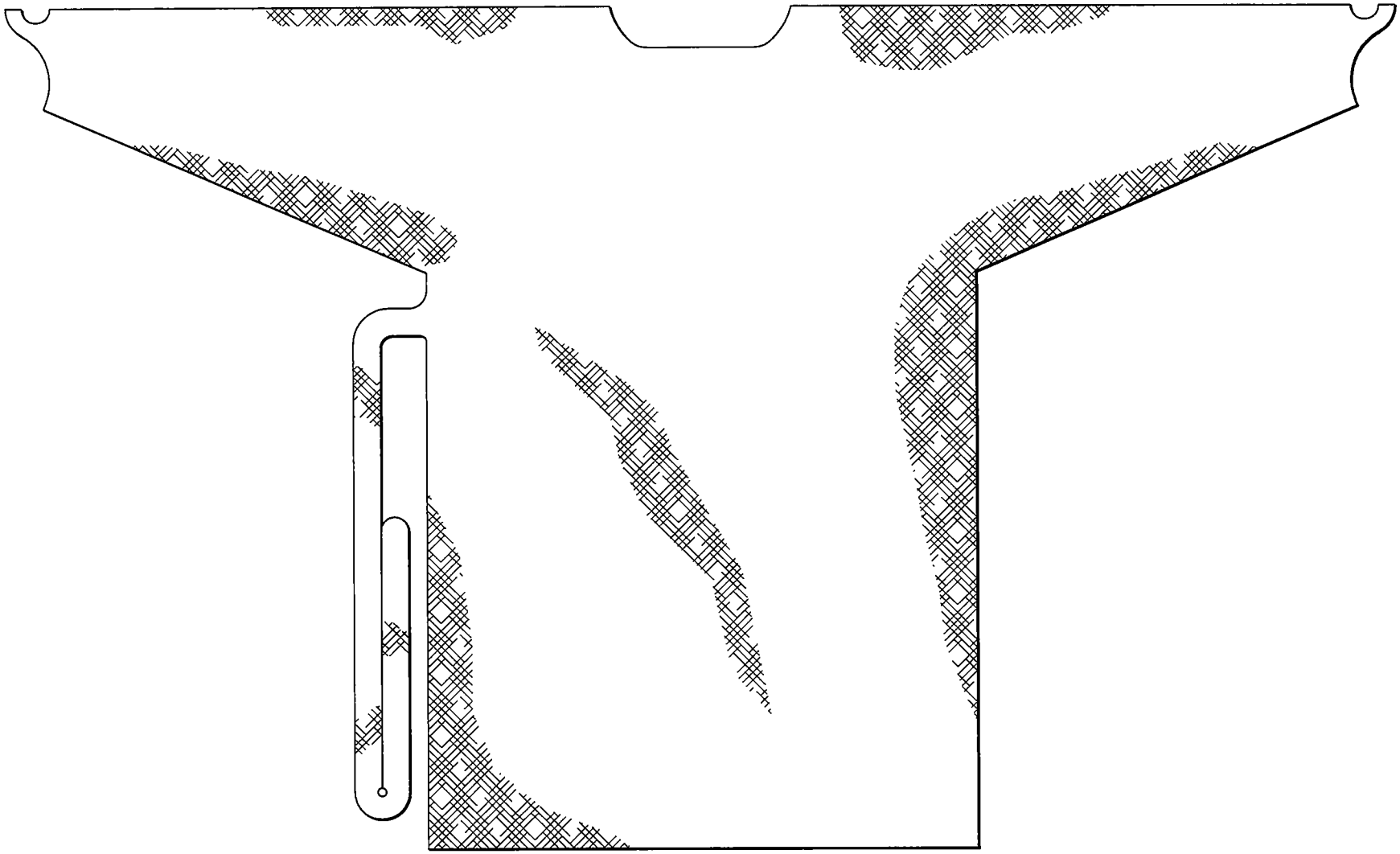
Figure 27:
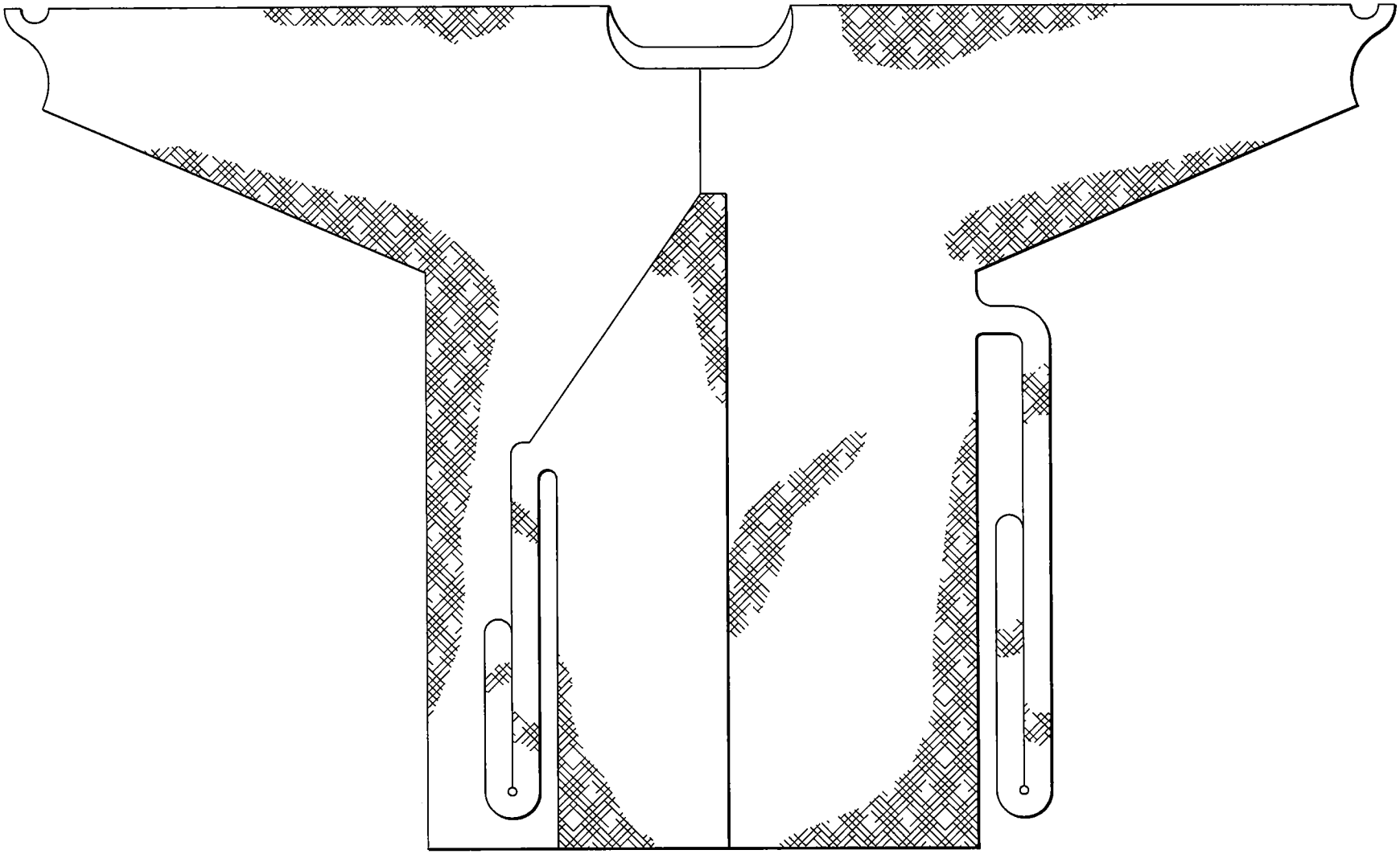
Figure 28:
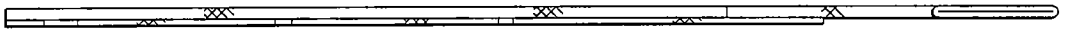
Figure 29:
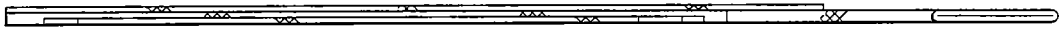
Figure 30:
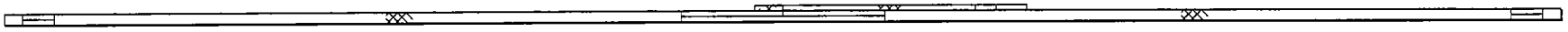
Figure 31:
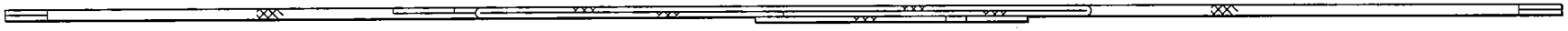
Figure 32:
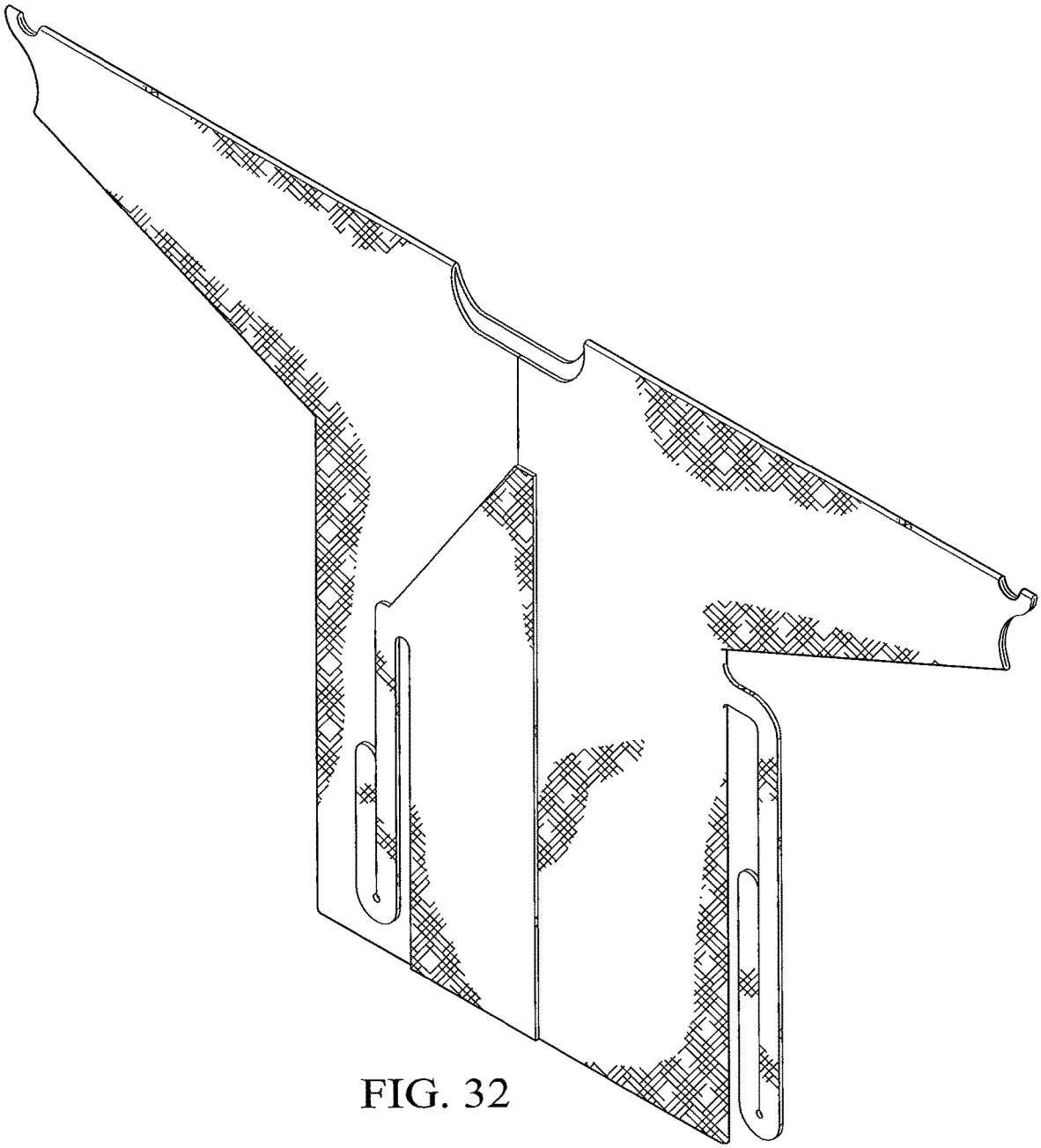
Figure 33:
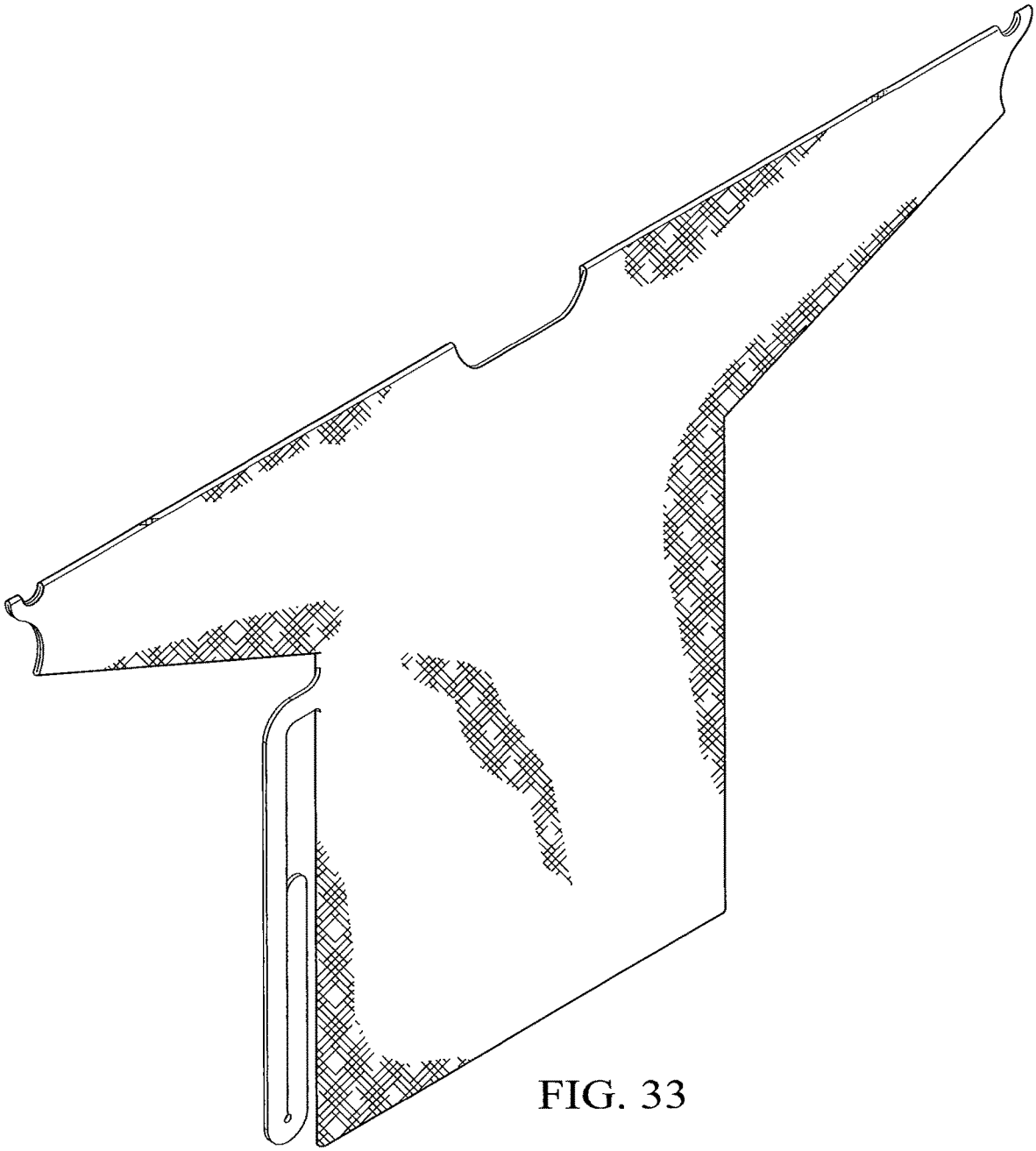
Figure 34:
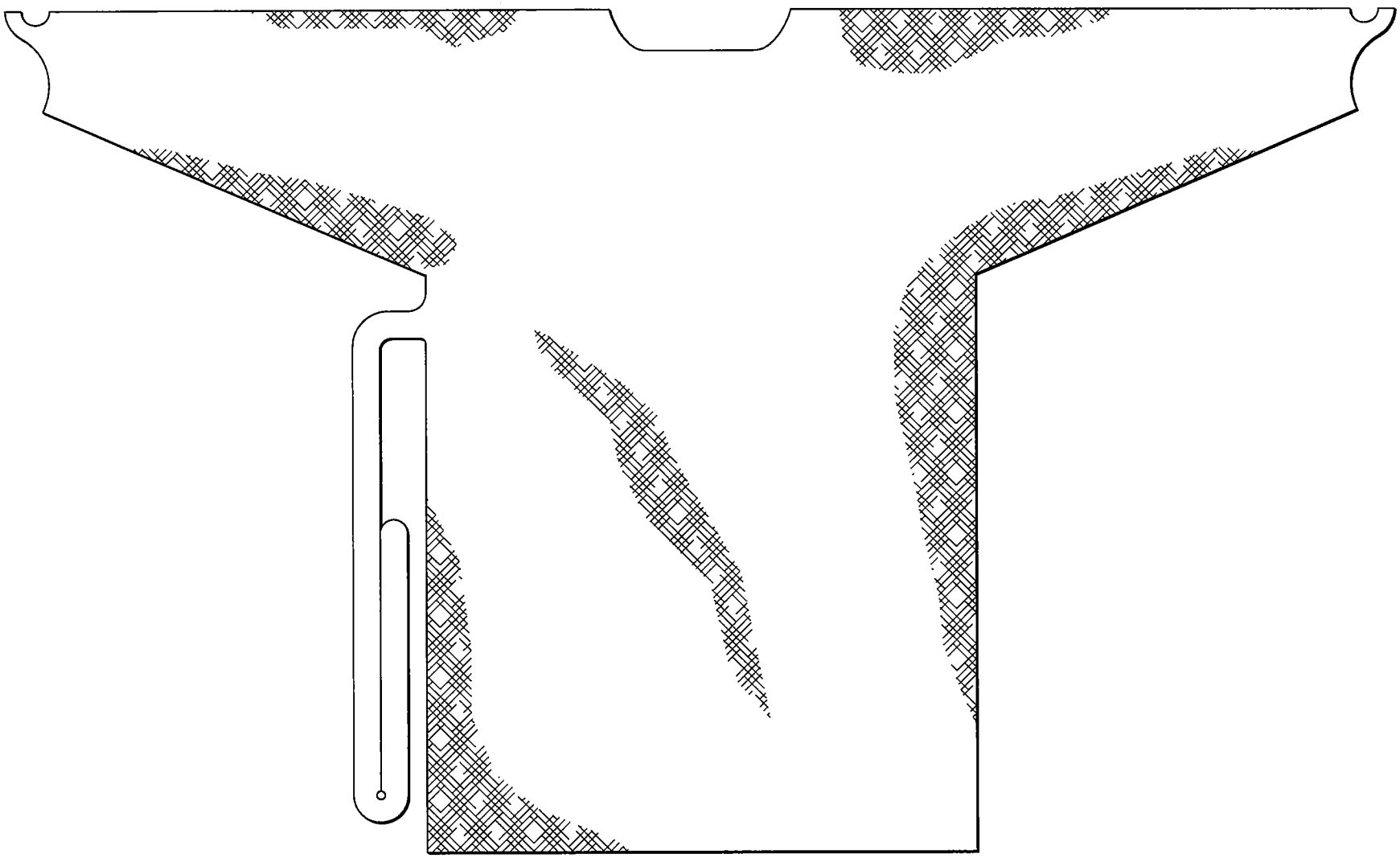
Figure 35:
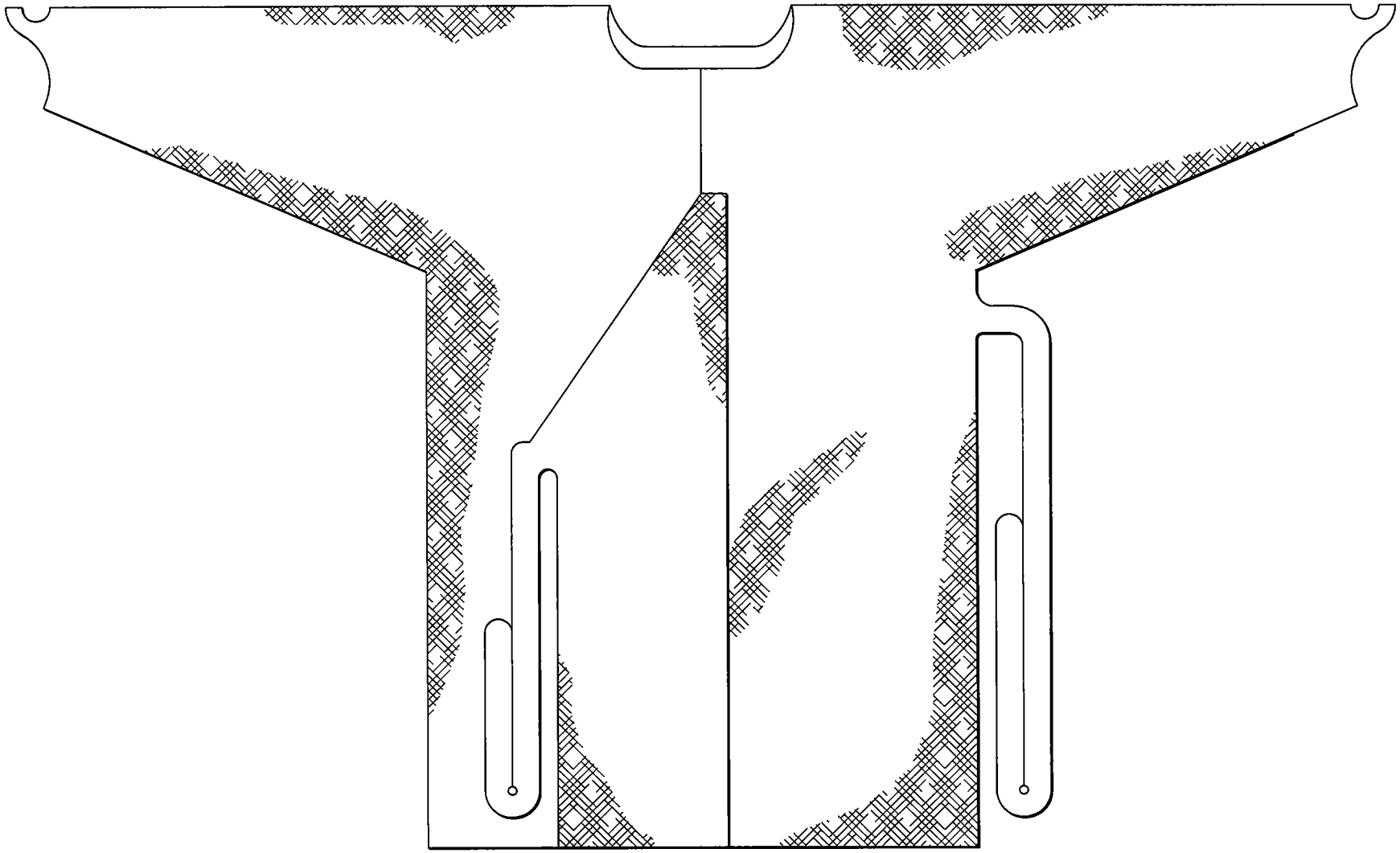
Figure 36:
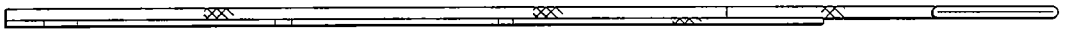
Figure 37:
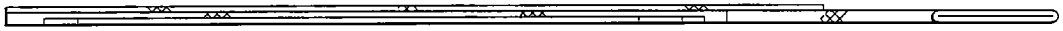
Figure 38:
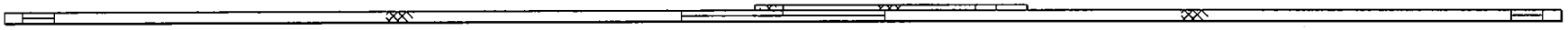
Figure 39:
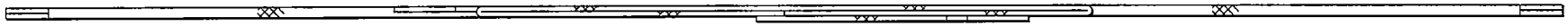
Figure 40:
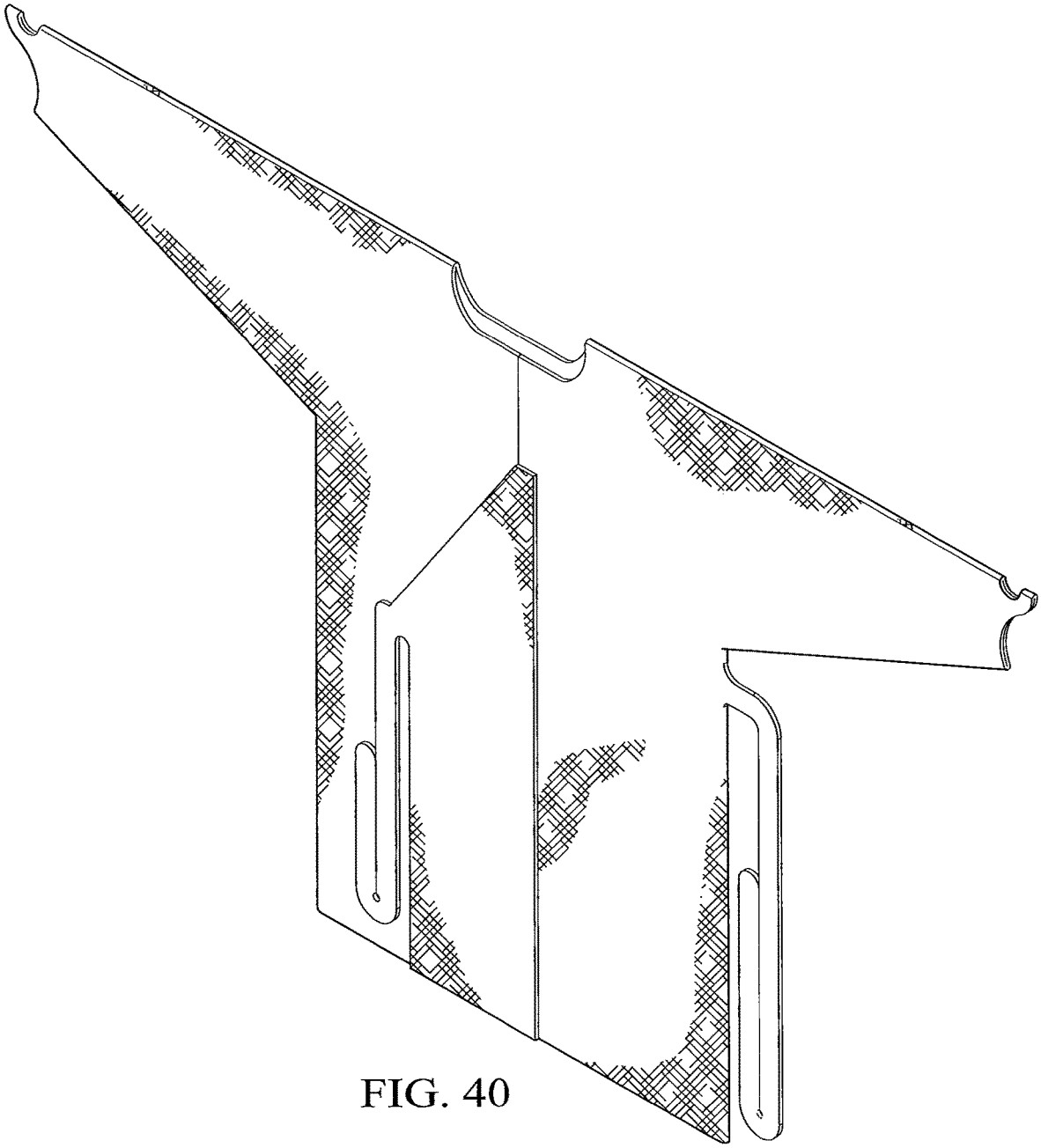
Figure 41:
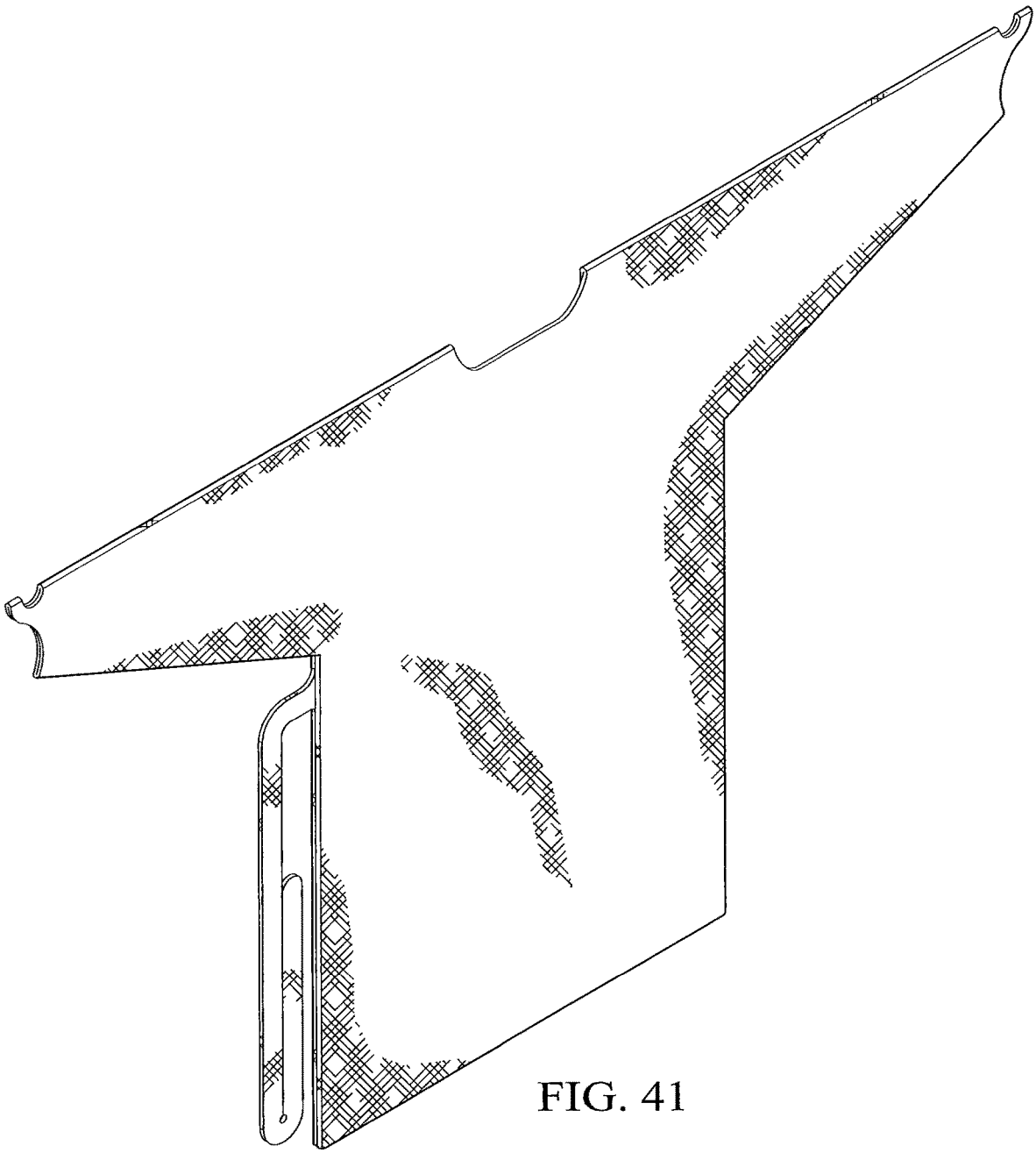
Figure 42:
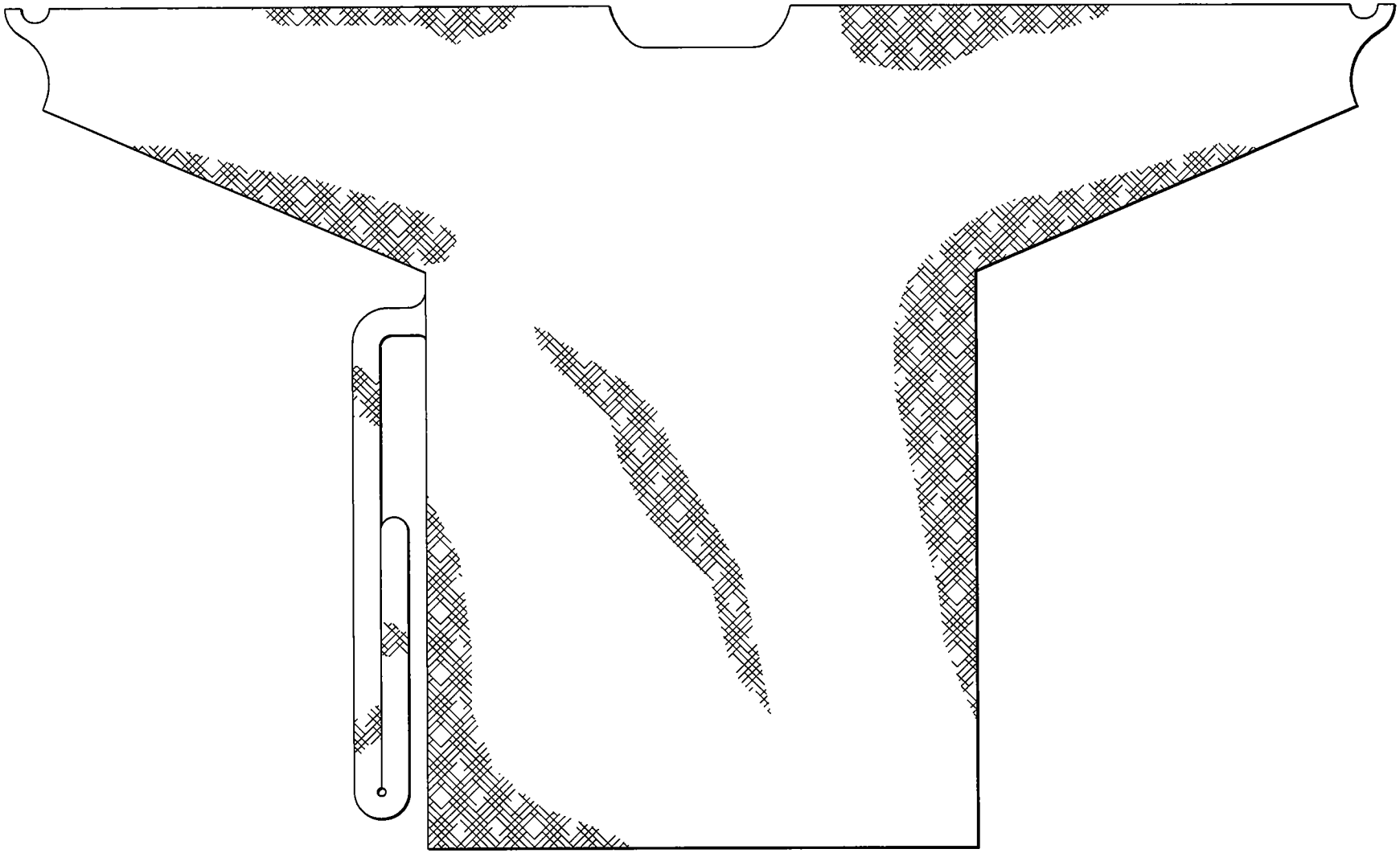
Figure 43:
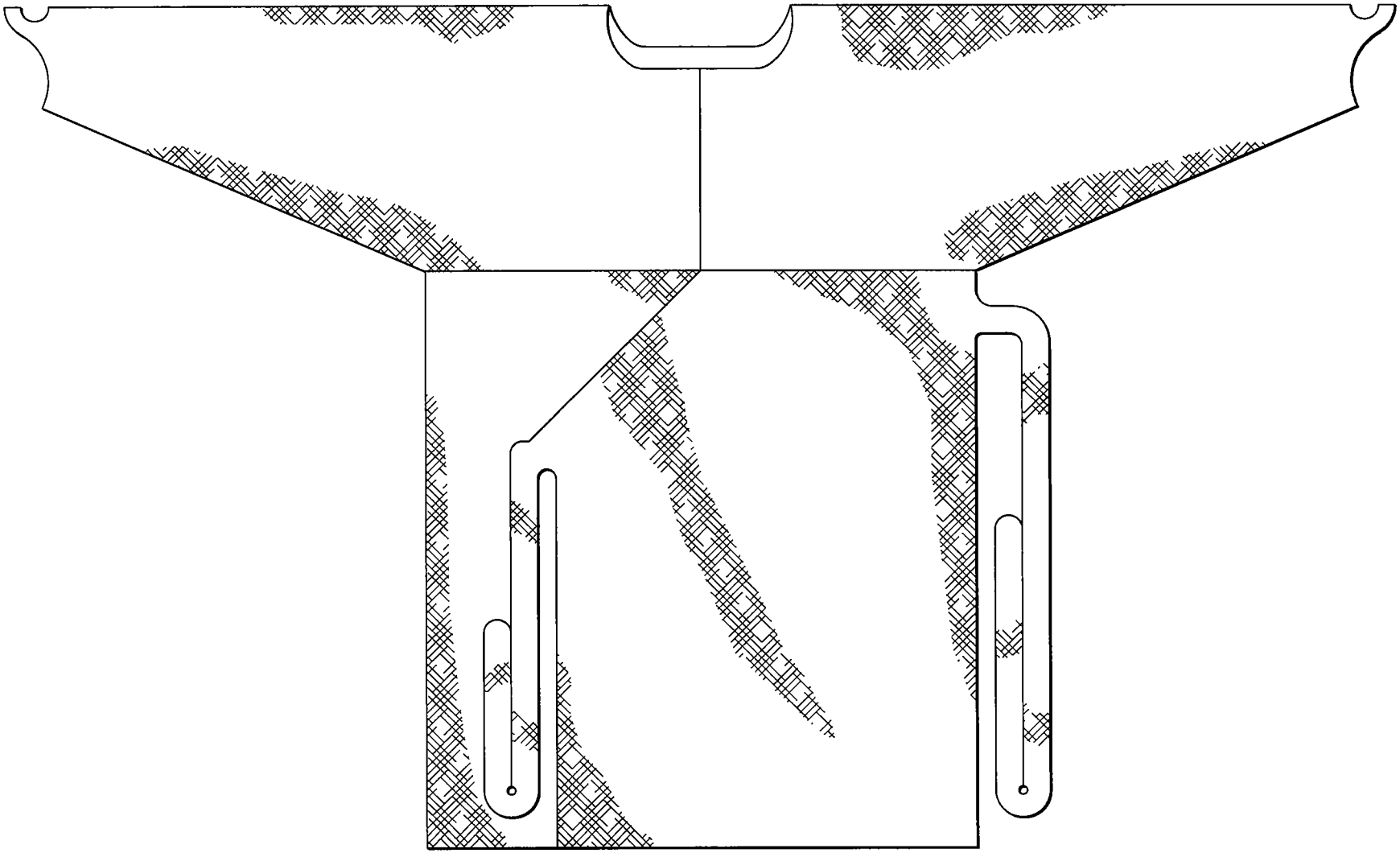
Figure 44:
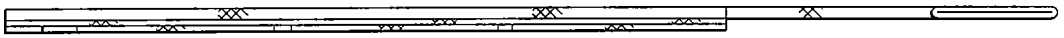
Figure 45:
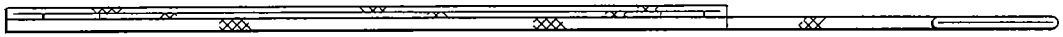
Figure 46:
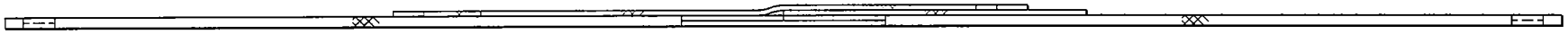
Figure 47:
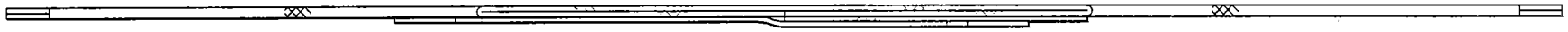
Figure 48:
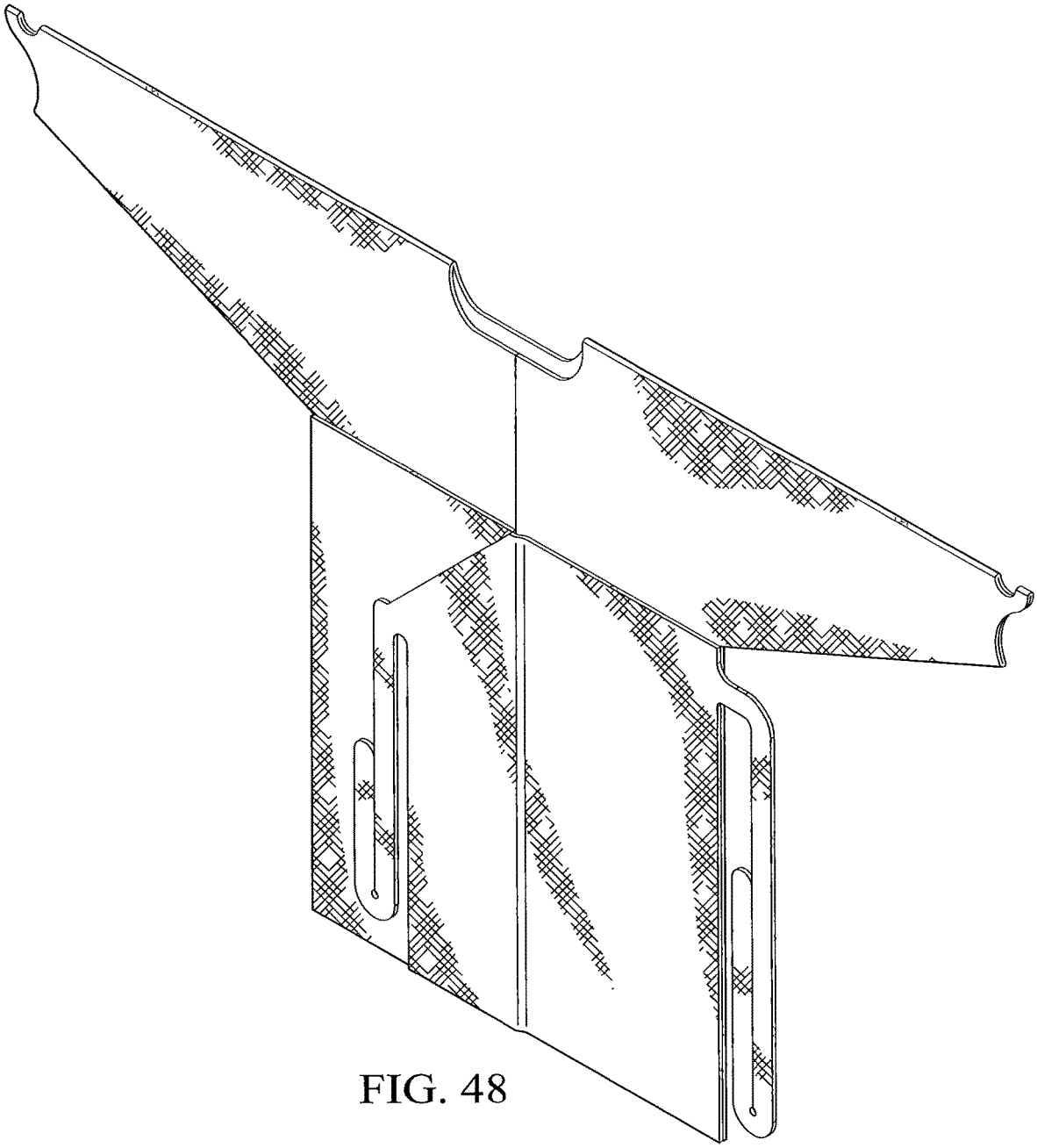
Figure 49:
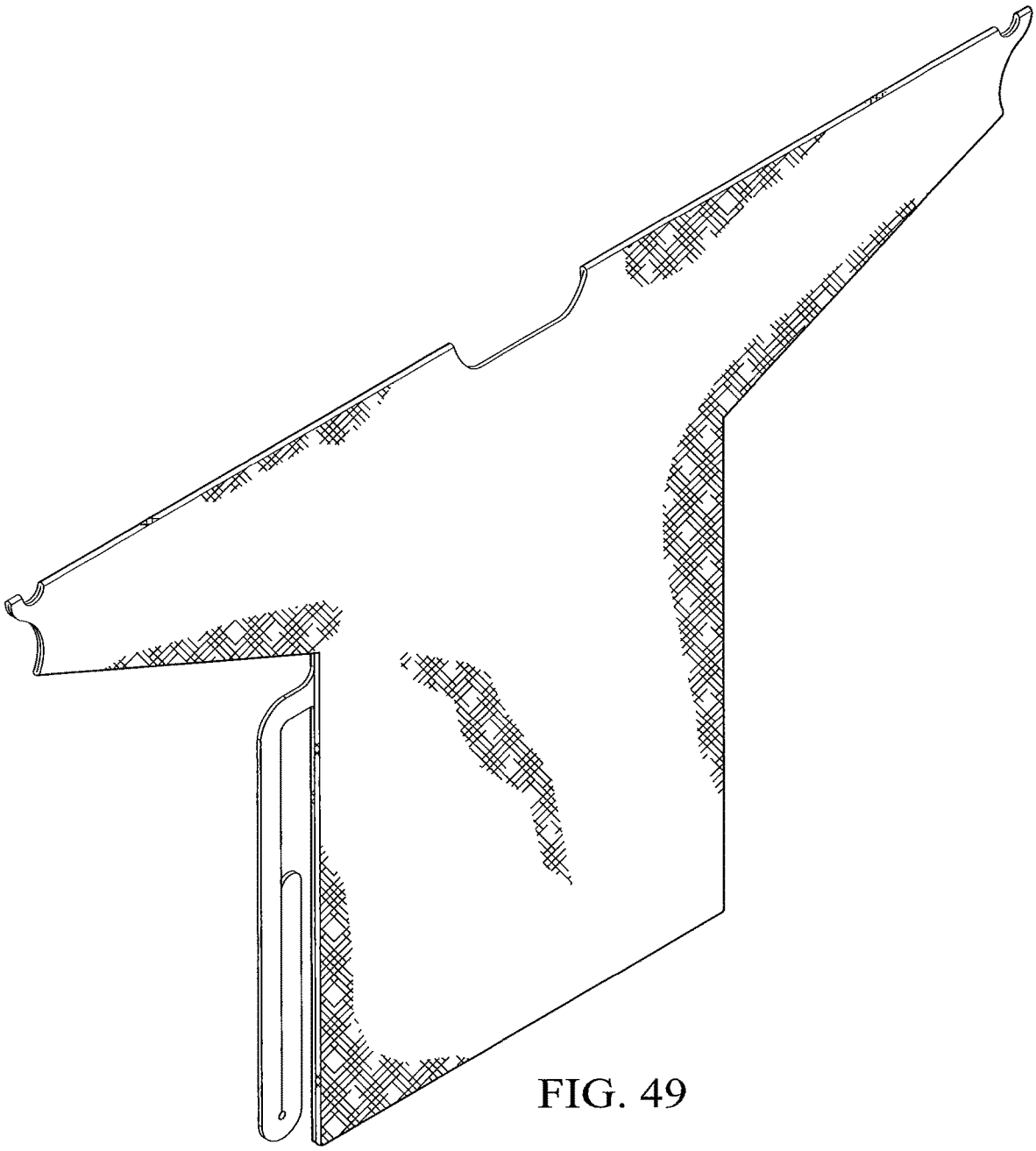
Figure 50:
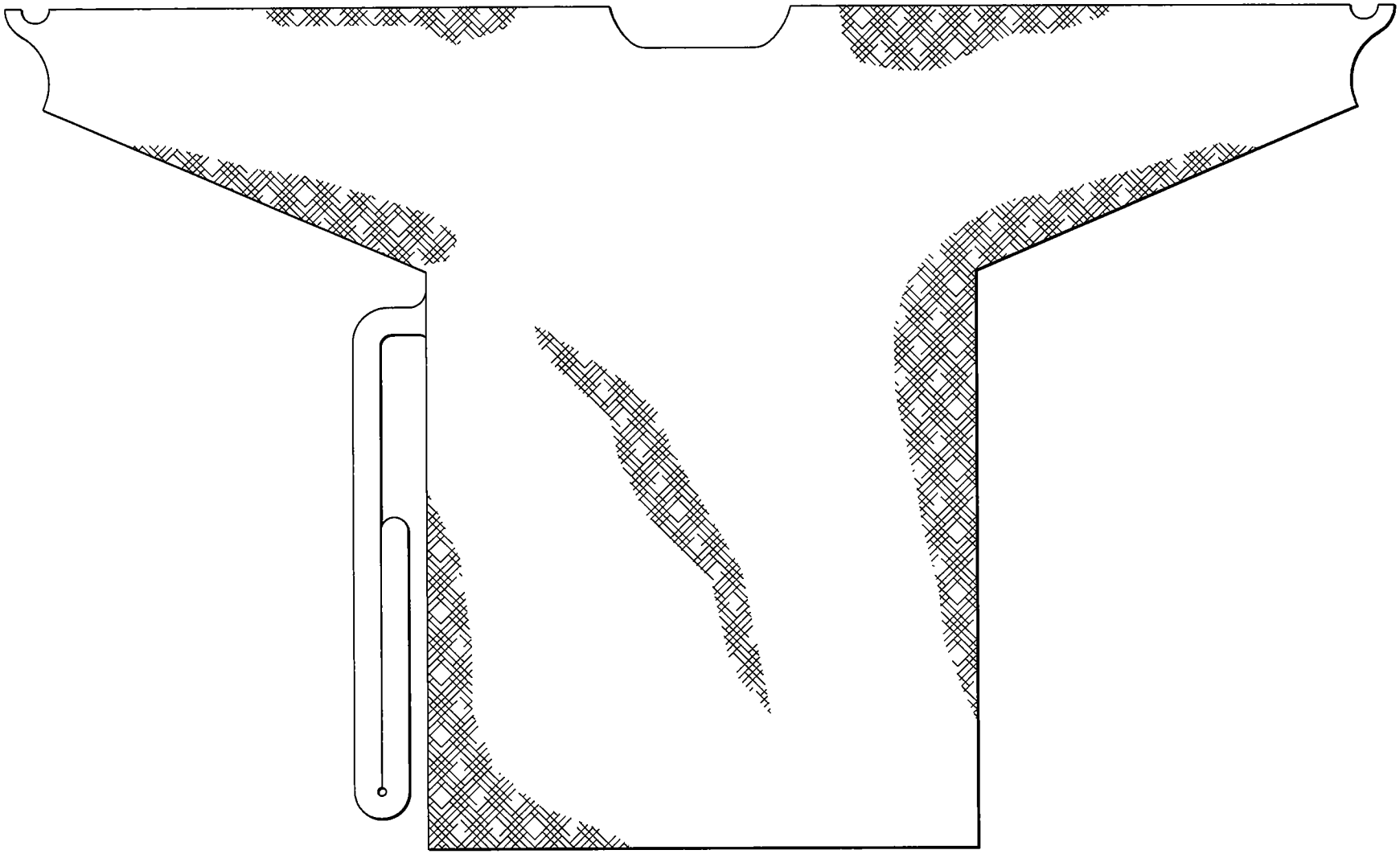
Figure 51:
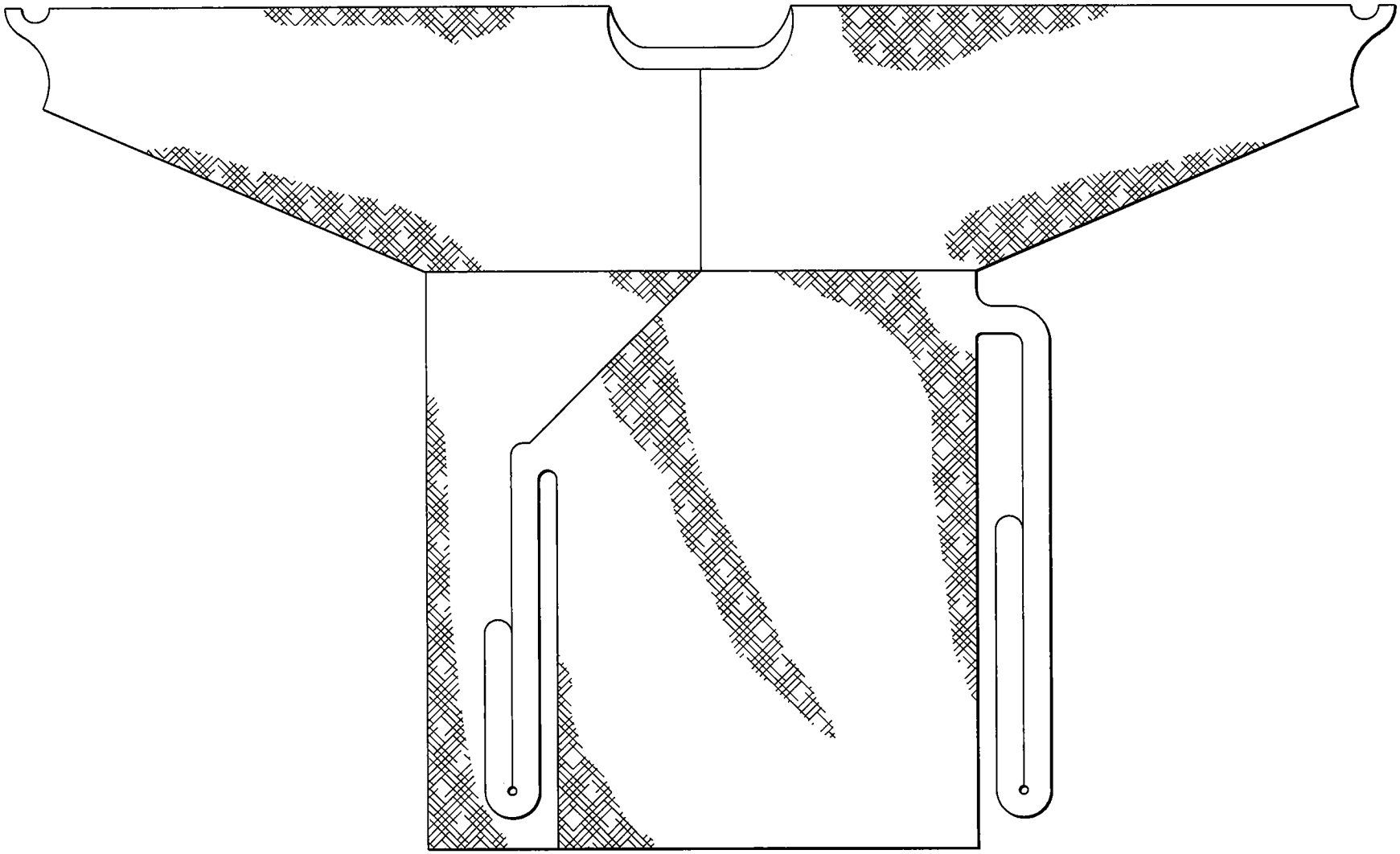
Figure 52:
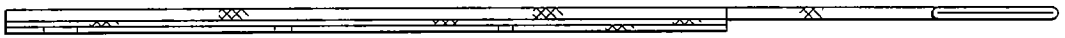
Figure 53:
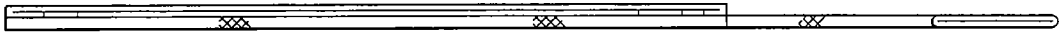
Figure 54:
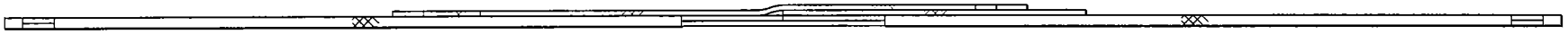
Figure 55:
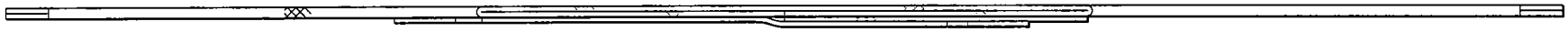
Figure 56:
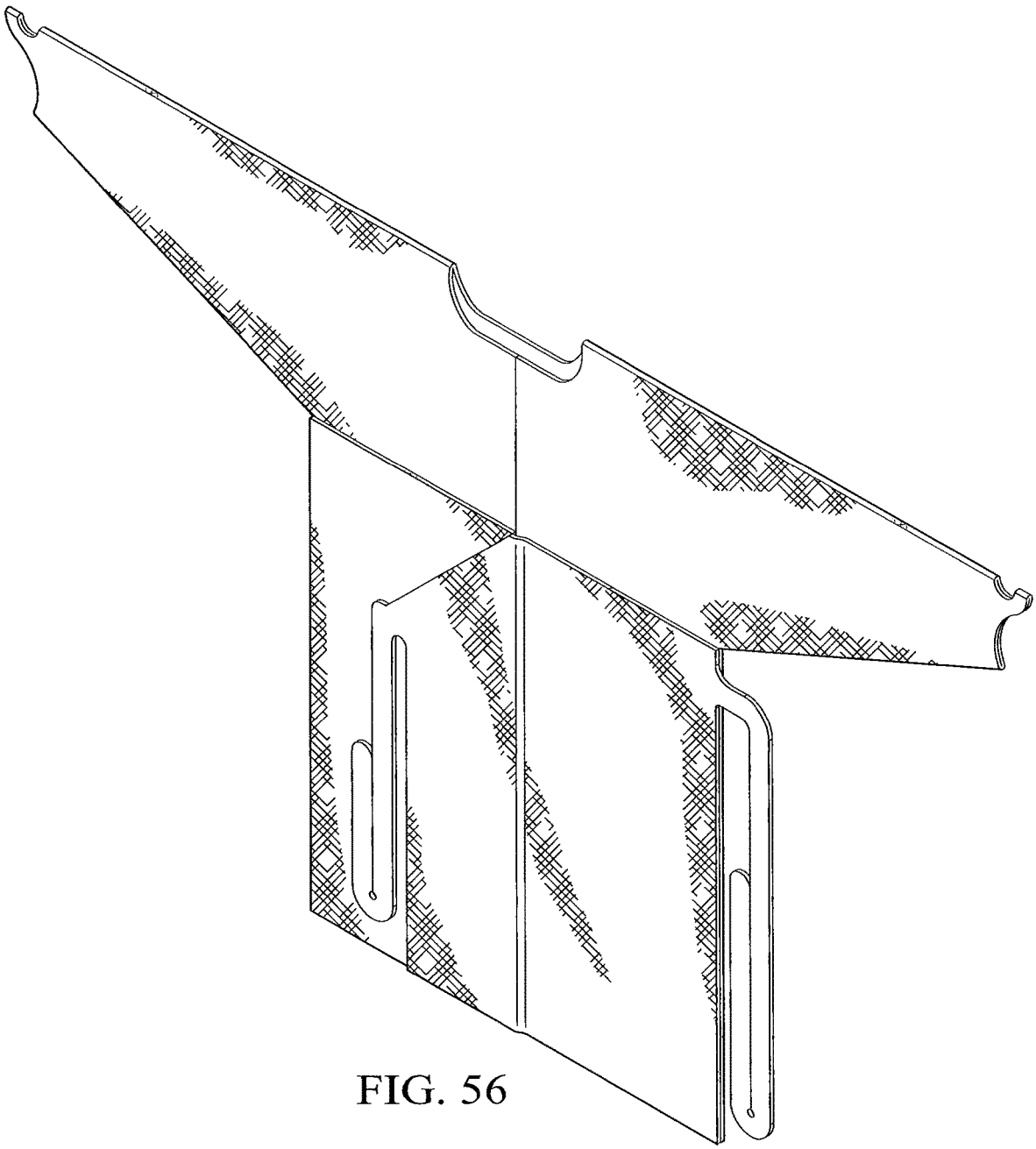

FIGS. 7A and 7B show an example schematic for assembling a garment according to the present disclosure, such as, for example, the garment shown in FIGS. 6A and 6B. Similar to the schematic shown in FIGS. 3A and 3B, assembling the garment may comprise providing a first component 71 and a second component 73. As shown in FIGS. 7A and 7B, the second component 73 may be generally rectangular. The schematic shown in FIGS. 7A and 7B also includes providing a third component 72. According to some aspects, the third component 72 may be generally trapezoidal and/or may comprise one or more portions of the closing device 74. It should be understood, however, that the second component 73 and/or the third component do not necessarily require the shapes discussed herein. For example, as shown in FIGS. 12A and 12B, the first component 121 and/or the second component 122 may be shaped such that, when the garment is assembled, the respective panels cover a portion or substantially all of the optional slit 123 of the first component 124 to reduce and/or eliminate the pre-closed portion of slit 123.

Figure 8:
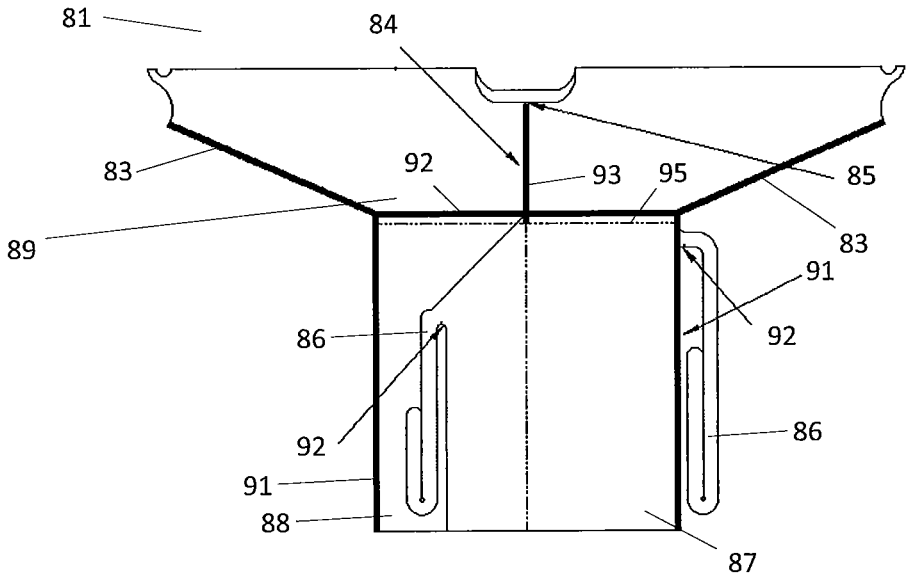
FIG. 8 shows an example back view of an assembled garment according to aspects of the present disclosure.

As shown in FIG. 7B, the garment may be assembled by first folding the first component 71 over along a line bisecting the neck opening. Similar to FIG. 4, FIG. 8 shows an example back view of the assembled garment 81, wherein the edges 83 of the first component (e.g., first component 71 shown in FIGS. 7A and 7B) are sealed together to form the garment. Alternatively or additionally, the garment may comprise at least one notch extending from the neck opening to a point on the front body portion and/or the back body portion, preferably the back body portion. For example, an optional slit 84 provided in the first component may be sealed and/or pre-closed along a pre-closed portion 93 in order to provide notch 85 in the assembled garment, similar to notch 48 shown in FIG. 4. Closing device 86 may further comprise slits 92, similar to slits 47 shown in FIG. 4.

It should be understood that FIG. 8 differs from FIG. 4 at least in regard to the panels. For example, whereas the garment shown in FIG. 4 comprises one panel 44 attached to the back body portion of the garment, the garment shown in FIG. 8 comprises a first panel 88 and a second panel 87 formed by attaching second component 73 and third component 72 shown in FIGS. 7A and 7B, respectively, to first component 71. As can be seen in FIG. 8, first panel 88 and second panel 87 may themselves form a portion of the body portion of the garment, in particular, a back body portion of the garment 89. In this example, the garment may be assembled by attaching the first panel 88 to the front body portion (not shown) of the garment at sides 91. The first panel 88 may also be attached to the back body portion 89 at the top 92 of panel 88 As shown in FIG. 8, the top 92 may be slightly above (for example, by between 0.1 and 4 cm) the edge 95 of the back body portion 89. Second panel 87 may also be attached to the back body portion 89 at the top 92 of panel 87 adjacent first panel 88 such that a portion of second panel 87 having closing device 86 thereon is not affixed to the back body portion (i.e., projects (e.g., laterally or at an angle) from the back body portion 89). As discussed in regard to FIG. 4, the same type of seal used to seal edges 83 and/or slit 84 of the garment may also be used to attach first panel 88 and/or second panel 87 to form the body portion of the garment. It should be understood, however, that a different type of seal may be used to attach first panel 88 and second panel 87 so long as the panels are adequately attached. First and second panels may be attached over the pre-closed portion 93 so that they overlap the pre-closed portion 93. Alternatively, first and second panels may not overlap the pre-closed portion 93.

Figure 11:
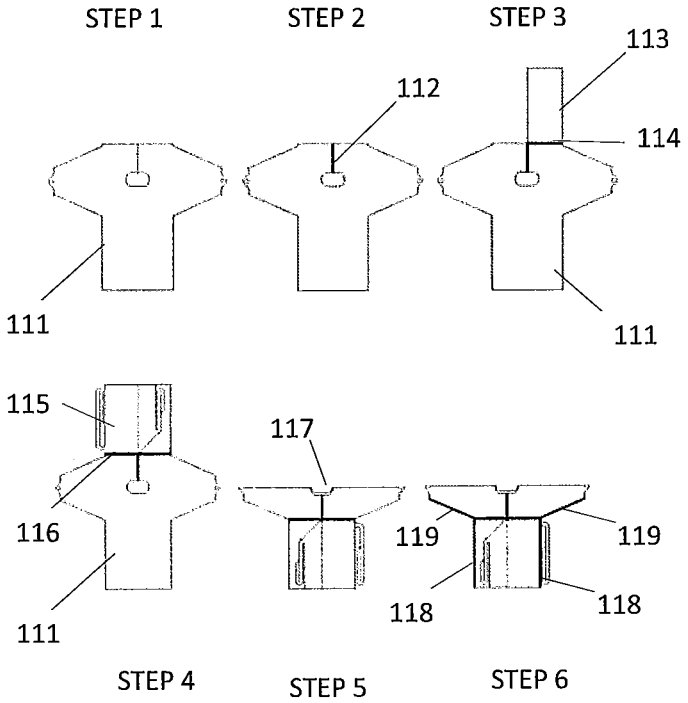
FIG. 11 shows an example schematic for assembling a garment according to aspects of the present disclosure.

FIG. 11 shows a second example schematic for assembling a garment according to the present disclosure, for example, the garment shown in FIGS. 6A and 6B. As can be seen in FIG. 11, assembling the garment may comprise providing a first component 111 in Step 1. In Step 2, a portion of the slit 112 may be sealed and/or pre-closed, as described herein (for example, with reference to FIG. 8). In Step 3, a second component 113 may be attached to the first component 111 along seal 114, as described herein (for example, with reference to FIG. 8). In Step 4, a third component 115 may be attached to the first component 111 along seal 116, as described herein (for example, with reference to FIG. 8). In Step 5, the garment may be assembled by folding the first component over along a line bisecting the neck opening 117. In Step 6, the garment may be sealed along the sides 118 and/or sleeves 119, as described herein (for example, with reference to FIG. 8).

Figure 9:
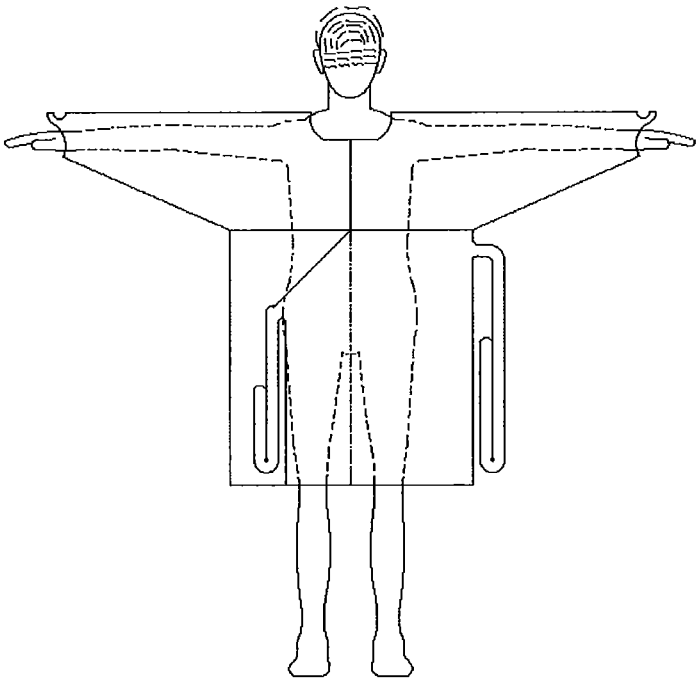
FIG. 9 shows an example back view of the garment shown in FIG. 8 when worn by a wearer according to aspects of the present disclosure.

FIG. 9 shows an example back view of the garment shown in FIG. 8 when worn by a wearer.

According to some aspects, one or more of the garment's components may be configured to provide an acceptable barrier between a wearer and certain contaminants. As used herein, the term "contaminants" refers to any environmental agent that may contaminate the garment wearer, examples of which include, but are not limited to, fluids, pathogens, and combination thereof.

As used herein, an "acceptable barrier" refers to a barrier that provides barrier function to a certain defined standard.

According to some aspects, the certain defined standard may be set according to AAMI (The Association for the Advancement of Medical Instrumentation) PB70, which relates to liquid barrier performance and classification of protective apparel and drapes intended for use in health care facilities. For example, according to some aspects, an "acceptable barrier" may refer to a garment that provides AAMI Level 1 protection, optionally AAMI Level 2 protection, optionally AAMI Level 3 protection, and optionally AAMI Level 4 protection. Although those skilled in the art will understand what is meant by AAMI Level 1 protection, AAMI Level 2 protection, AAMI Level 3 protection, and AAMI Level 4 protection, it should be understood that AAMI Level 4 protection refers to a garment in compliance with ASTM (American Society for Testing and Materials) F1671 (Standard Test Method for Resistance of Materials Used in Protective Clothing to Penetration by Blood-Borne Pathogens Using ϕX174 Bacteriophage Penetration as a Test System).

According to some aspects, one or more of the garment's components may be configured to provide an acceptable barrier. For example, according to some aspects, one or more of the garment's components may comprise a material that provides acceptable barrier function. In some aspects, the main body portion, the two sleeves, the closing device, the one or more panels, or any combination thereof may comprise the material. Materials acceptable for use according to the present disclosure include, but are not limited to, woven fabrics, knitted fabrics, nonwoven fabrics such as an SMS polypropylene, composites of polyethylene, spunbond polypropylene, spunbound SMS, and/or spunbond with bi-component fibers (e.g., polypropylene/polyethylene or polyethylene/polyethylene terephthalate core and sheath), SMS with hollow fibers, spunbond polypropylene with hollow fibers, and/or other films laminated by heat, ultrasonic, or adhesive to a nonwoven fabric, and combinations thereof, including microporous and/or monolithic breathable films such as Hytrel® thermoplastic elastomers and Arnitel® thermoPlastic copolyester (TPC), other breathable monolithic resins such as Pebax® polyamide block copolymer, polyurethane, polyethylene microporous film, and/or polypropylene microporous film, monolithic non-breathable films such as those containing polyethylene, polypropylene, and/or polyolefin, and combinations thereof.

According to some aspects, one or more of the seals used to assemble the garment may be configured to provide acceptable barrier function. For example, one or more of the seals described herein may be provided using a linear sealing technique such as heat sealing, ultrasonic welding, RF welding techniques, the use of adhesive, and combinations thereof. According to some aspects, one or more of the seals described herein may provide a barrier function that is at least the same as the barrier function provided by the material used for one or more of the garment's components.

According to some aspects, one or more portions of the garment may be designed to provide acceptable barrier function. For example, one or more portions of the garment may be free of any openings, gaps, perforations, holes, and/or slits that may compromise the garment's barrier function, for example, by allowing contaminants to penetrate the garment to an unacceptable level.

According to some aspects, the garment may be configured to provide easy donning and/or doffing while still providing acceptable barrier function. For example, the garment may comprise one or more doffing features that aid in doffing, that is, removal of the garment from a wearer. According to some aspects, the one or more doffing features may comprise one or more of the slits and/or notches, such as those described herein, wherein the slits and/or notches provide a point of the garment that is more easily torn than other portions of the garment. In this way, when doffing is required, the garment may be easily torn and removed. It should be understood that, for example, the notches as described herein may comprise a linear break in material (e.g., a linear cut or slit) and/or an angled break in material (e.g., a "v-shape" cut).

For example, referring to the garment shown in FIG. 4, the one or more doffing features may comprise slits 47 and notch 48. When doffing is required, the garment may be easily torn by starting at the doffing features and creating a tear. It should be understood, however, that alternatively or additionally, the garment may be torn by starting at any acceptable portion of the garment, for example, any portion of the garment that comprises a tear-able material, which may or may not include an explicit doffing feature. The tear may, for example, follow closely or exactly one or more of the seals (e.g., the pre-closed portion 52 of slit 43, as shown in FIG. 4). Alternatively or additionally, the tear may follow closely or exactly a perforation and/or a score line in the garment (e.g., a mechanical tear method). Alternatively or additionally, the tear may follow closely or exactly a material border, such as border between two different materials, and/or along a tear-able material that is weakened or otherwise configured to facilitate tearing, such as by a tear-able tape (e.g., a material tear method). In this way, the garment may be easily doffed without requiring any openings, gaps, perforations, holes, and/or slits in the garment that may compromise the garment's barrier function during use.

According to some aspects, one or more of the doffing features may have a length that is no more than about 2 inches, optionally no more than about 1.5 inches, optionally no more than about 1 inch, optionally no more than about 0.9 inch, optionally no more than about 0.8 inch, optionally no more than about 0.7 inch, optionally no more than about 0.6 inch, optionally no more than about 0.5 inch, optionally no more than about 0.4 inch, optionally no more than about 0.3 inch, optionally no more than about 0.2 inch, optionally no more than about 0.1 inch.

According to some aspects, the garment may be configured to provide easy donning, that is, putting the garment on a wearer. For example, the garment may be configured such that when the garment is put on a wearer, it immediately provides barrier function, even if, for example, the closing device is not secured. In one particular example, in emergency situations, the front portion of the garment may provide acceptable barrier function even if the garment is only placed over the head of a wearer (i.e., the neck of a wearer is placed through the neck opening without the closing device(s) and/or back portion of the garment being closed and/or secured).

According to some aspects, the garment may be sterilized, for example, by subjecting the garment to a sterilization process. It should be understood that the garment may be sterilized (e.g., subjected to the sterilization process) prior to the assembly process of the garment and/or after the assembly process of the garment and/or at any point therebetween.

The present disclosure is also directed to methods of making and using the garments as described herein. For example, the garments may be used to protect a wearer during a medical procedure, such as during surgery, chemotherapy treatment, or any medical procedure wherein barrier function is required. The present disclosure is also directed to methods of doffing the garment described herein. For example, the method may comprise creating a tear starting at one or more of the doffing features and then removing the garment from a wearer. The present disclosure is also directed to methods of donning the garment.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Thus, the claims are not intended to be limited to the aspects shown herein, but are to be accorded the full scope consistent with the language of the claims, where reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

Further, the word "example" is used herein to mean "serving as an example, instance, or illustration." Any aspect described herein as "example" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. Nothing disclosed herein is intended to be dedicated to the public regardless of whether such disclosure is explicitly recited in the claims.

The word "about" is used herein to mean within ±5% of the stated value, optionally within ±4%, optionally within ±3%, optionally within ±2%, optionally within ±1%, optionally within ±0.5%, optionally within ±0.1%, and optionally within ±0.01%.

The following examples are put forth so as to provide those of ordinary skill in the art with a complete disclosure and description of how to make and use the present invention, and are not intended to limit the scope of what the inventors regard as their invention nor are they intended to represent that the experiments described below are all or the only experiments performed. Efforts have been made to ensure accuracy with respect to numbers used (e.g. amounts, dimensions, etc.) but some experimental errors and deviations should be accounted for.

Examples

The following is an example test performed to evaluate the barrier function of a garment intended to protect against contaminants, specifically blood borne pathogen hazards, according to ASTM F1671. To perform this test, test garments (or portions thereof) are conditioned for a minimum of 24 hours at 21±5° C. and 30-80% relative humidity (RH), and then tested for viral penetration using a ϕX174 bacteriophage suspension. The portion of the garments tested may be any portion thereof, including sleeves, body portions, closing devices, panels, and portions and combinations thereof. At the conclusion of the test, the observed side of the test garment (or portion thereof) is rinsed with a sterile medium and assayed for the presence of ϕX174 bacteriophage. The pre-test concentration (PFU/mL) and the post-test concentration (PFU/mL) of the ϕX174 bacteriophage and the assay titer (PFU/mL) are then calculated. This data, along with a visual penetration inspection, are used to determine if the test results in a pass, fail, or acceptable designation.

The invention claimed is:

1. A method for preparing a garment, the method comprising:

(a) forming a front body portion of the garment by:

providing a first component comprising a neck opening, wherein the first component comprises a slit extending from the neck opening to a first edge of the first component, and folding the first component over along a line bisecting the neck opening; and (b) forming a back body portion of the garment by:

attaching a first panel to the first component via a first seal, and attaching a second panel to the first component via a second seal, wherein the first seal and the second seal are contiguous and are offset from the first edge of the first component by a first distance, wherein the first panel and the second panel are separated from the neck opening by a portion of the first component, and wherein the first panel and the second panel, together, form an entire width of the back body portion, wherein the first panel, the second panel, and the first component together form the back body portion, the back body portion configured to cover substantially all of a back torso of a wearer, and wherein the first seal and the second seal are provided using heat sealing, ultrasonic welding, an RF welding technique, an adhesive, or a combination thereof.

2. The method of claim 1, wherein the method further comprises providing at least a portion of the slit in a pre-closed configuration.

3. The method of claim 2, wherein the portion of the slit is provided in the pre-closed configuration via a third seal.

4. The method of claim 2, wherein the portion of the slit is provided in the pre-closed configuration via a one or more fasteners.

5. The method according to claim 2, wherein the slit further comprises an open portion extending from the neck opening to a first end of the pre-closed portion in order to provide a notch.

6. The method according to claim 5, wherein the notch has a length of no more than about 2 inches.

7. The method according to claim 5, wherein the first panel and/or the second panel overlap substantially all of the pre-closed portion.

8. The method according to claim 5, wherein the first panel comprises a rectangular shape and the second panel comprises a trapezoidal shape.

9. The method according to claim 1 wherein the second panel comprises a first portion of a closing device;

wherein a portion of the second panel comprising the first portion of the closing device overlaps at least a portion of the first panel.

10. The method according to claim 9, wherein the second panel further comprises a second portion of the closing device, wherein the closing device comprises a belt, and wherein at least one of the first portion of the closing device and the second portion of the closing device comprises a slit.

11. The method of claim 1, wherein the garment provides acceptable barrier function, wherein acceptable barrier function is AAMI Level 1 protection.

12. The method of claim 1, wherein the garment provides acceptable barrier function, wherein acceptable barrier function is AAMI Level 4 protection.

13. A garment comprising:

a front body portion, the front body portion comprising a first portion of a first component;

a back body portion, the back body portion comprising a second portion of the first component, a first panel, and a second panel;

a first sleeve, the first sleeve comprising a third portion of the first component;

a second sleeve, the second sleeve comprising a fourth portion of the first component;

a neck opening provided in the first component; and a slit extending from the neck opening to a first edge of the first component;

wherein the first panel is attached to the first component via a first seal and the second panel is attached to the first component via a second seal, wherein the first seal and the second seal are contiguous and are offset from the first edge of the first component by a first distance, wherein the first panel and the second panel are separated from the neck opening by a portion of the first component, and wherein the first panel and the second panel, together, form an entire width of the back body portion, wherein the first panel, the second panel, and the second portion of the first component together form the back body portion, the back body portion configured to cover substantially all of a back torso of a wearer, and wherein the first seal and the second seal are provided via heat sealing, ultrasonic welding, an RF welding technique, an adhesive, or a combination thereof.

14. The garment of claim 13, wherein at least a portion of the slit is provided in a pre-closed configuration.

15. The garment of claim 14, wherein the portion of the slit is provided in the pre-closed configuration via a seal.

16. The garment of claim 14, wherein the portion of the slit is provided in the pre-closed configuration via a one or more fasteners.

17. The garment of claim 13, wherein the garment provides acceptable barrier function, wherein acceptable barrier function is AAMI Level 1 protection.

18. The garment of claim 13, wherein the garment provides acceptable barrier function, wherein acceptable barrier function is AAMI Level 4 protection.

* * * * *